US005952991A

United States Patent [19]

Akiyama

[11] Patent Number: 5,952,991

[45] Date of Patent: Sep. 14, 1999

[54] LIQUID CRYSTAL DISPLAY

[75] Inventor: Masahiko Akiyama, Ota-ku, Japan

[73] Assignee: Kabushiki Kaisha Toshiba, Kawasaki, Japan

[21] Appl. No.: 08/748,897

[22] Filed: Nov. 14, 1996

[51] Int. Cl.[6] ..... G09G 3/36

[52] U.S. Cl. ..... 345/98; 345/90; 345/92; 345/93

[58] Field of Search ..... 345/98, 87, 90, 345/92, 97, 103, 91, 104, 93, 94; 349/33, 34, 36, 41–53

[56] References Cited

U.S. PATENT DOCUMENTS 5,515,072 5/1996 Yanai et al. ..... 345/96
5,534,884 7/1996 Mase et al. ..... 345/92
5,610,627 3/1997 Inamori et al. ..... 345/97
5,712,652 1/1998 Sato et al. ..... 345/90

*Primary Examiner*—Dennis-Doon Chow
*Attorney, Agent, or Firm*—Pillsbury Madison & Sutro LLP

[57] ABSTRACT

A liquid crystal display apparatus includes systems of voltage applying devices for applying voltages to a liquid crystal and a controlling device for switching among these systems. The systems of voltage applying devices each have at least one non-linear switching element, and the controlling device has a memory portion for storing the switched state. With such a construction, electric power loss caused by one signal line having a relatively high frequency can be avoided by using another signal line having a relatively low frequency, thereby allowing a white, black, or gradation display with reduced power consumption.

24 Claims, 16 Drawing Sheets

LIQUID CRYSTAL DISPLAY

BACKGROUND OF THE INVENTION

1. Field of the Invention

The present invention relates to a liquid crystal display apparatus, in particular, to an active-matrix type liquid crystal display apparatus.

2. Description of the Related Art

Liquid crystal displays are used as display apparatuses of low-power consumption, small-thickness, and light-weight type. Particularly, in active-matrix type liquid crystal displays that use thin film transistors for individual pixels, even if the number of pixels is increased, moving pictures can be displayed with a high picture quality including high contrast and high response. Thus, the liquid crystal displays have been used in computers as well as TV sets as essential components.

In recent years, portable computers have been widely used because they can receive, edit, and send information anytime and anyplace. In this situation, it is very important to reduce the power consumption of the apparatuses so as to prolong the operation time thereof. To reduce the power consumption, various techniques have been employed. However, the power consumption of liquid crystal displays needs to be further reduced.

FIG. 21 is a schematic diagram showing a structure of a display portion of a conventional active-matrix type liquid crystal display apparatus. FIG. 22 is a schematic diagram showing a structure of a circuit of a pixel portion of the conventional liquid crystal display apparatus.

One transistor is disposed at each pixel. With a voltage applied to a gate line, the transistor is turned on. The voltage of the signal line at the point is applied to the liquid crystal. When another pixel is driven, the gate voltage is decreased so as to turn off the transistor. Thus, the electric charge is stored in the liquid crystal and a capacitor.

Normally, an AC voltage must be applied to the liquid crystal. In addition, to suppress the screen's flickering, the liquid crystal should be driven at a frequency so that the eyes of human beings cannot detect the AC voltage (for example, at 60 Hz). Thus, even if a picture does not move (namely, a still picture), pulses must be always applied to the signal line and gate line.

The driving circuit of the signal line is composed of a shift register, a sample hold circuit, and an output buffer. Normally, so as to successively sample a display signal in a predetermined interval, the clock frequency is obtained as the reciprocal of the scanning interval divided by the number of signal lines. In the case of a display having 1280×1024 pixels, the clock frequency becomes around 80 MHz. The power consumption of the driving circuit is proportional to the clock frequency. In addition, the power consumption of the liquid crystal panel is obtained by (applied voltage)$^2$× (capacitance)×(frequency). The frequency of the signal change of the signal line is the reciprocal of the scanning interval. Thus, the frequency of the signal change is around 61 kHz. Consequently, since the power consumption is proportional to the frequency, as long as the refresh rate of the liquid crystal is fixed, it is difficult to reduce the power consumption.

For example, the power consumption of a LCD with a diagonal length of 10.4 inches in VGA (640×480 pixels) is around 1 W. Thus, the LCD cannot be used for a display apparatus of a portable information unit for a long time. In addition, liquid crystal display apparatuses that have high resolutions corresponding to screen information tend to require high power consumption. Thus, it is very important to reduce the power consumption of liquid crystal display apparatuses.

On the other hand, a known technique uses a ferroelectric liquid crystal that has a memory property for allowing the refresh rate and thereby the power consumption to decrease. However, when the liquid crystal has the memory property, gradation display cannot be performed. Thus, in this case, the number of display colors is markedly decreased. Consequently, the display quality of the liquid crystal display apparatus is markedly deteriorated.

The present invention is made from the above-described point of view. An object of the present invention is to provide a liquid crystal display apparatus that can markedly reduce the power consumption of the driving circuit without adversely affecting the display quality. Another object of the present invention is to provide a liquid crystal display apparatus that has low power consumption that allows a portable information unit used with the apparatus to operate for a long time.

SUMMARY OF THE INVENTION

The present invention includes a liquid crystal display apparatus, comprising a plurality of systems of voltage applying means for applying voltages to a liquid crystal, the plurality of systems of voltage applying means having at least one non-linear switching element, and a controlling means for switching the plurality of systems of voltage applying means from one to another, the controlling means having a memory portion for storing the switched state.

The controlling means may have a ferroelectric capacitor.

The liquid crystal display apparatus comprises a first voltage applying means for applying a voltage at a first frequency to the liquid crystal, a second voltage applying means for applying a voltage at a second frequency to the liquid crystal, the second frequency being lower than the first frequency, and a controlling means for switching the voltage applying means from one to the other, the controlling means having a memory portion for storing the switched state. The controlling means may have a ferroelectric capacitor, the polarity of the ferroelectric capacitor being inverted by the first or second voltage applying means.

The second frequency may be set to 30 Hz or 60 Hz. When the second frequency is set to 60 Hz, the user does not suffer from the flickering of the display.

The present invention includes a liquid crystal display apparatus, comprising a first circuit for connecting or disconnecting a voltage applied to a first signal line corresponding to a voltage applied to a gate line and applying the voltage of the first signal line to a liquid crystal, and a second circuit for connecting or disconnecting a voltage applied to a second signal line corresponding to a voltage applied from the first circuit and applying the voltage of the second signal line to the liquid crystal, the second circuit having a memory portion that stores the connection/ disconnection state, the voltage of the first signal line being also applied to the second circuit.

The first signal line and the second signal line may be disposed in parallel or perpendicularly.

The liquid crystal display apparatus of the present invention further may include a thin film transistor having a ferroelectric film disposed between a gate electrode and a semiconductor film for connecting a source electrode and a drain electrode through a contact region. The liquid crystal display apparatus may have a plurality of gate lines, a plurality of signal lines, a first transistor connected to the gate lines and signal lines connected to each pixel. A voltage may be applied to a liquid crystal with the pixel electrode connected to the first transistor. The first transistor may be a voltage applying means. The apparatus further may comprise a circuit as a second voltage applying means for applying an AC voltage to the liquid crystal and a controlling means for switching one of a plurality of voltage applying means, the circuit as the second voltage applying means having a memory portion for storing the state according to whether or not the voltage has been applied to the liquid crystal.

Since the liquid crystal display apparatus according to the present invention comprises a plurality of voltage applying means (including driving circuits thereof) for driving the liquid crystal and the controlling means for switching the plurality of voltage applying means from one to the another, the controlling means having the switched state, a plurality of display modes can be selected. With a display mode having a low driving frequency, the power consumption of the display apparatus is markedly reduced. As the display mode, a gradation driving mode with high picture quality can be also selected.

The liquid crystal display apparatus according to the present invention may have a plurality of signal line driving circuits for driving individual signal lines. Alternatively, with a common driving circuit, the plurality of signal lines may be managed. With the plurality of voltage applying means, voltages may be applied to individual opposite electrodes.

The plurality of voltage applying means may have a strobe line for driving the controlling means.

The controlling means may be composed of a combination of non-linear switching elements such as a capacitor and a thin film transistor.

The capacitors may be composed of a normal dielectric insulation film and a ferroelectric insulation film or a combination thereof.

In the liquid crystal display apparatus according to the present invention, a circuit is composed of a transistor. Alternatively, the circuit may be composed of a non-linear switching element such as a diode or a MIM (Metal-Insulator-Metal).

The liquid crystal layer according to the present invention is of guest-host type of which a nematic liquid crystal is the host and a color dye is the guest. Alternatively, a black dye may be used as the guest. In addition, another type of liquid crystal such as polymer-dispersed liquid crystal, cholesteric type liquid crystal, or super-homeotropic liquid crystal or anti-ferroelectric liquid crystal may be used.

According to the present invention, the activation layer of the thin film transistor is formed of amorphous silicon. Alternatively, the activation layer may be formed of a non-single crystal silicon or another semiconductor layer such as Te or CdSe.

The ferroelectric capacitor used for the liquid crystal display apparatus according to the present invention is composed of a crystal film of barium titanate. As another ferroelectric insulation film, a perovskite type ferroelectric substance such as PZT ($PbZr_xTi_{1-x}O_3$), PLZT ((Pb, La)(Zr, Ti)$O_3$) may be used. Alternatively, a compound such as $BaMgF_4$ or layered compound such as layered perovskite, $Ba_4Ti_3O_{12}$ or $SrBi_2Ta_2O_9$, or metal oxide such as gadolinium molybdate, $Gd_2(MoO_4)_3$ may be used. In addition, an organic ferroelectric substance such as a copolymer of vinylidene fluorite and trifluoro ethylene or a copolymer of poly (vinylidene fluoride) and trifluoro ethylene may be used.

These and other objects, features and advantages of the present invention will become more apparent in light of the following detailed description of best mode embodiments thereof, as illustrated in the accompanying drawings.

DESCRIPTION OF PREFERRED EMBODIMENTS

With reference to the accompanying drawings, a liquid crystal display apparatus according to the present invention will be described in detail.

Figure 1A:
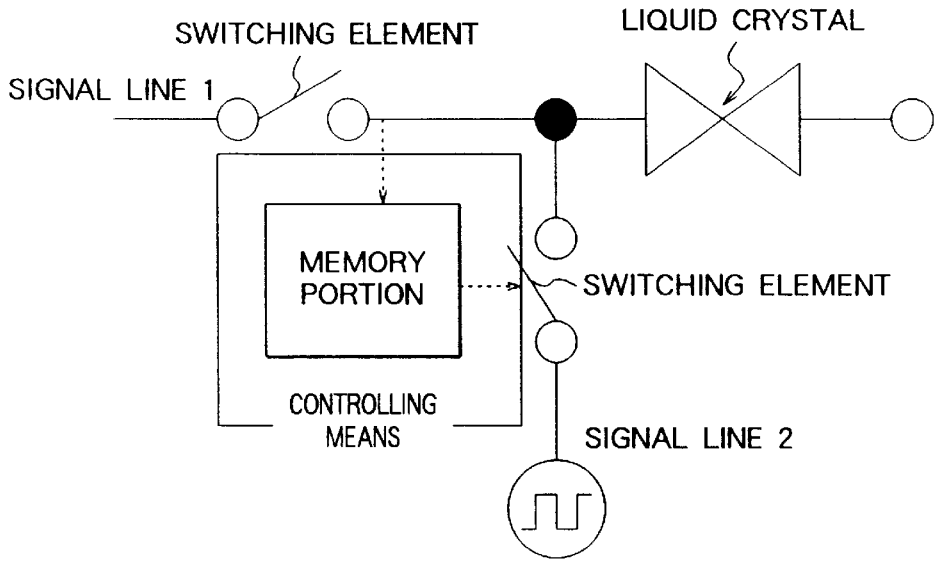
FIG. 1A is a schematic diagram showing a pixel of a liquid crystal display apparatus according to the present invention.
Figure 1B:
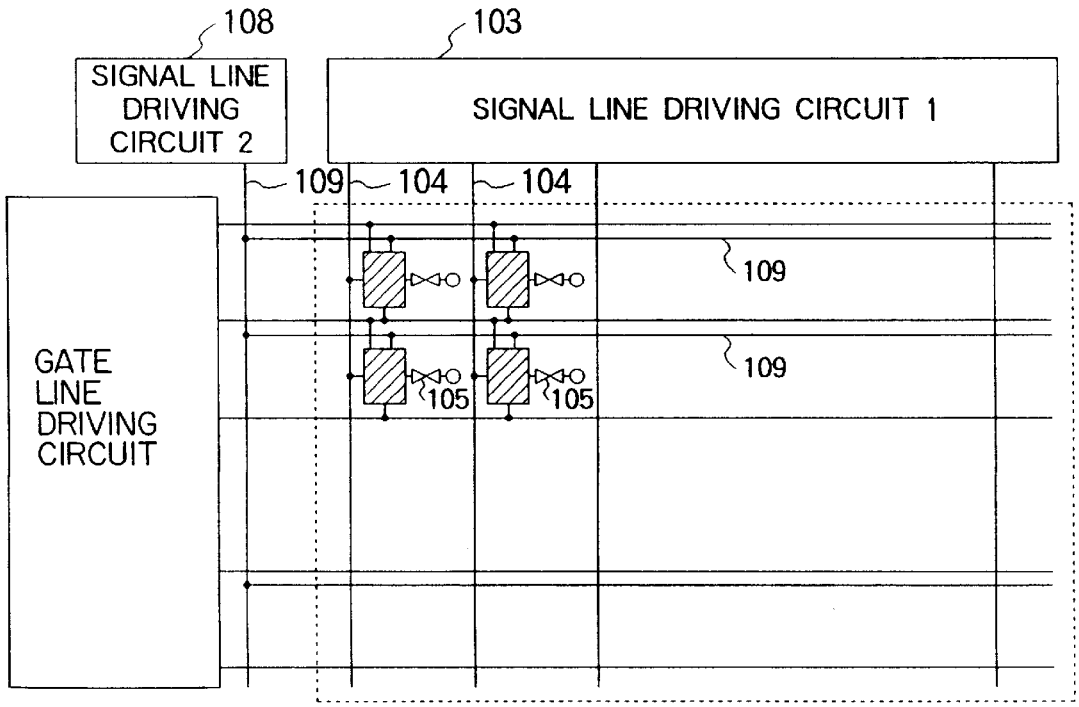
FIG. 1B is a schematic diagram showing an example of the structure of the liquid crystal display apparatus according to the present invention.
Figure 2A:
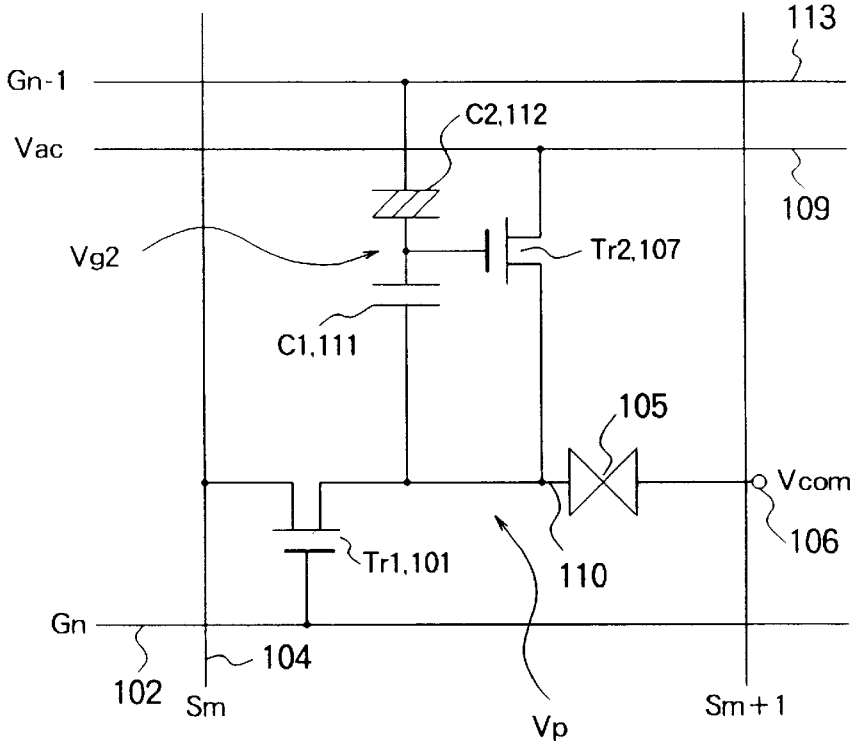
FIGS. 2A and 2B are schematic diagrams showing structures of pixel circuits of the liquid crystal display apparatus according to the present invention.
Figure 2B:
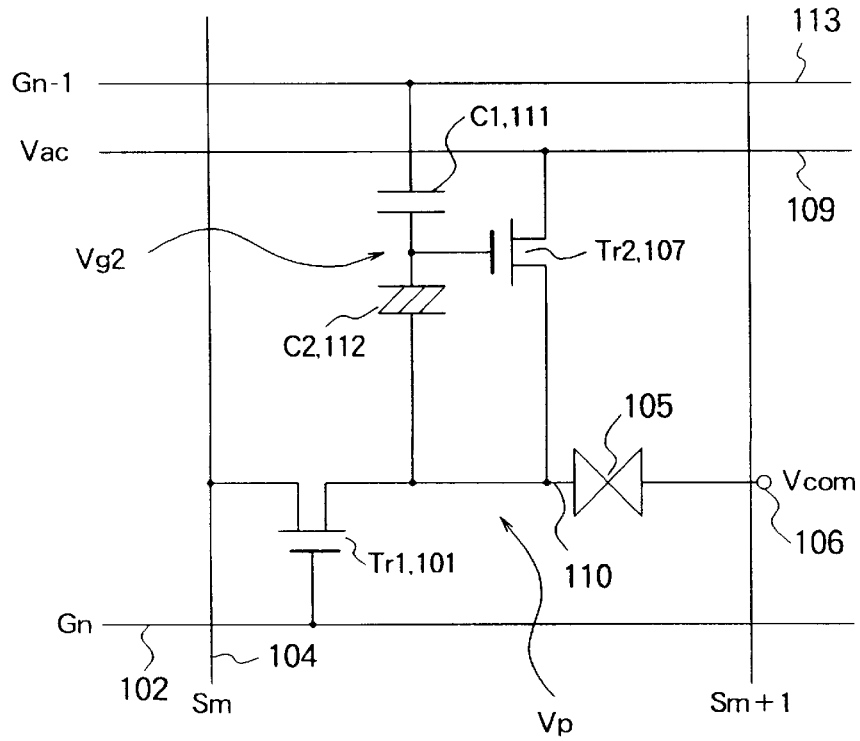

FIG. 1A is a schematic diagram showing a pixel of the liquid crystal display apparatus according to the present invention. FIG. 1B is a schematic diagram showing an example of the structure of the liquid crystal display apparatus according to the present invention. FIGS. 2A and 2B are schematic diagrams showing examples of the structure of one pixel circuit of the liquid crystal display apparatus shown in FIG. 1.

Next, with reference to FIG. 2A, the liquid crystal display apparatus according to the present invention will be described. A first voltage applying means of the liquid crystal display apparatus according to the present invention has a thin film transistor (Tr1) 101. A gate electrode of the thin film transistor (Tr1) 101 is connected to a gate line (Gn) 102. A source electrode of the thin film transistor (Tr1) 101 is connected to a signal line (Sm) 104 that is connected to a first signal line driving circuit 103. A drain electrode of the thin film transistor (Tr1) 101 is connected to a pixel electrode 110 that is connected to a liquid crystal layer 105. The transmissivity of the liquid crystal layer 105 is varied corresponding to the voltage across the pixel electrode 110 and an opposite electrode 106. The voltage of the opposite electrode 106 is denoted by Vcom.

A second voltage applying means has a thin film transistor (Tr2) 107. A source electrode of the thin film transistor (Tr2) 107 is connected to a second signal line (Vac) 109 that is connected to a second signal line driving circuit 108. A drain electrode of the thin film transistor (Tr2) 107 is connected a pixel electrode 110 that is connected to the liquid crystal layer 105. A gate electrode of the thin film transistor (Tr2) 107 is connected to a controlling means that switches the voltage applying means from one to the other and that has a memory portion that stores the switched state.

The controlling means is composed of a capacitor (C1) 111 and a capacitor (C2) 112. The capacitor (C1) is composed of a normal dielectric insulation film. The capacitor (C2) 112 is composed of a ferroelectric insulation film. The capacitors C1 and C2 are connected in series. The capacitor C1 is connected to the pixel electrode 110. The capacitor C2 is connected to a gate line (Gn−1) 113 on the preceding stage. The gate electrode of the thin film transistor (Tr2) 107 and the connection point between the capacitors C1 and C2 are connected.

Alternatively, as shown in FIG. 2B, the capacitor (C2) 112 may be composed of a ferroelectric insulation film, while the capacitor (C1) 111 may be composed of a normal dielectric insulation film. In addition, the capacitor C2 (112) is connected to the pixel electrode.

In the liquid crystal display apparatus shown in FIG. 1, transistors are used. However, other non-linear switching elements such as diodes may be used for the liquid crystal display apparatus. The liquid crystal layer is of guest-host type where a nematic liquid crystal is used as the host and a color dye is used as the guest. Alternatively, a black dye may be used as the guest. In addition, another liquid crystal such as polymer-dispersed type liquid crystal or super homeotropic liquid crystal or anti-ferroelectric liquid crystal may be used. In the case that a normally-black liquid crystal is used, when no voltage is applied, the liquid crystal is colored (in the case of a black dye, it is referred to as black image). When the voltage is applied, the liquid crystal becomes transparent as a white image. The activation layers of the thin film transistors are composed of amorphous silicon. However, the activation layers may be composed of non-single crystal silicon, polycrystalline silicon, Te, CdSe, or the like.

The ferroelectric insulation film of the capacitor (C2) 112, which composes the pixel circuit of the liquid crystal display apparatus shown in FIGS. 2A and 2B, is composed of a crystal film of barium titanate. The ferroelectric insulation film may be composed of a perovskite type ferroelectric substance such as PZT ($PbZr_xTi_{1-x}O_3$), PLZT ((Pb, La)(Zr, Ti)$O_3$), or the like. Alternatively, the ferroelectric insulation film may be composed of a compound such as $BaMgF_4$ or a layered compound such as $Ba_4Ti_3O_{12}$ or $SrBi_2Ta_2O_9$. In addition, the ferroelectric insulation film may be composed of an organic ferroelectric substance such as a copolymer of vinylidene fluorite and trifluoro ethylene or a copolymer of poly(vinylidene fluoride) and trifluoro ethylene.

Figure 3:
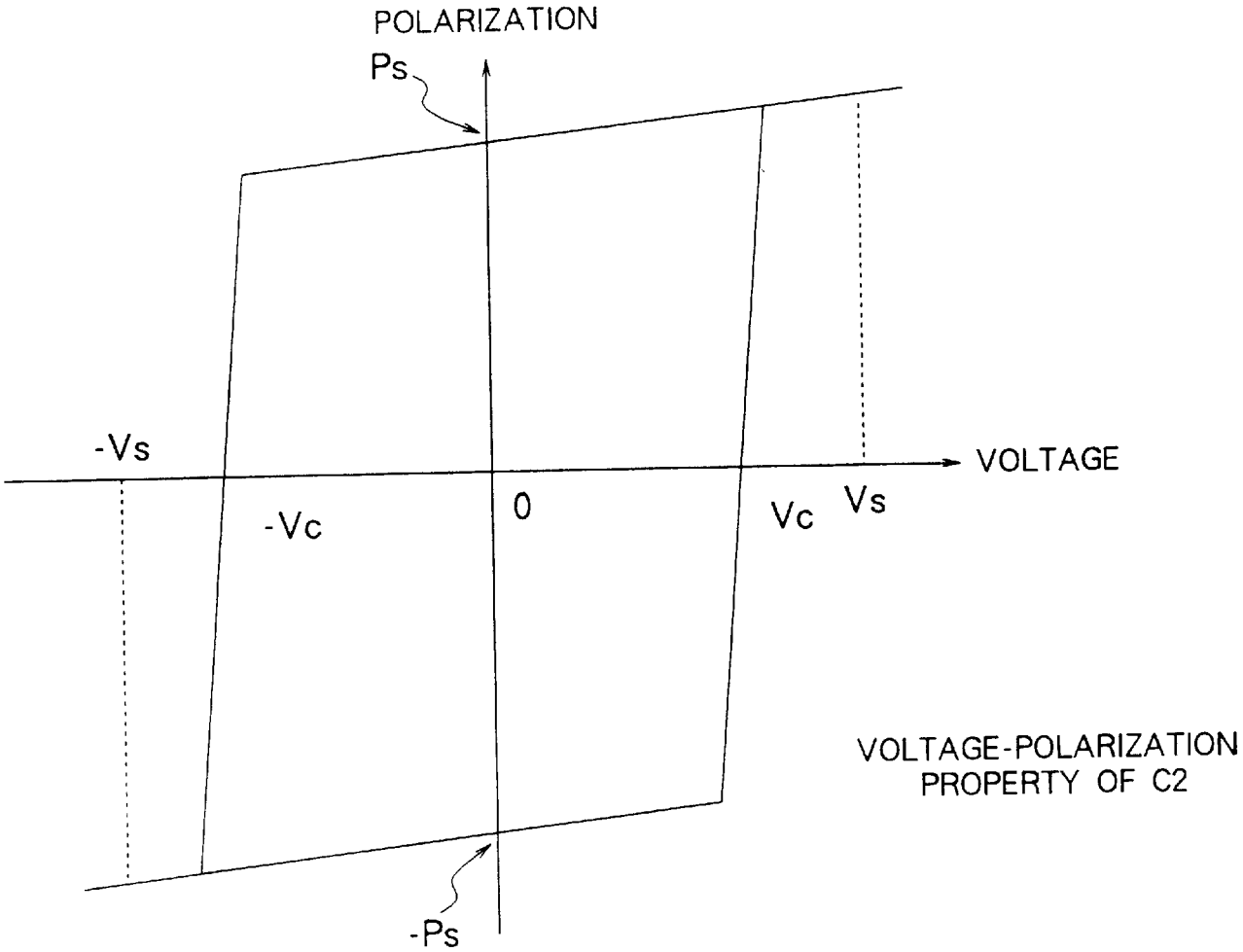
FIG. 3 is a graph showing a polarization property of a ferroelectric capacitor.

FIG. 3 shows a property of the ferroelectric capacitor (C2) 112. When the horizontal axis represents the voltage V applied to the capacitor and the vertical axis represents the polarization P, a hysteresis as shown in FIG. 3 is drawn. When a voltage exceeding Vc obtained from a coercive field Ec is applied to the ferroelectric capacitor (C2) 112, the polarization becomes positive. Even if the voltage becomes 0, a spontaneous polarization Ps resides. When a voltage −Vc or below is applied, the polarization is inverted to be negative polarization.

First, the normal gradation driving mode will be described. In this case, the ferroelectric capacitor (C2) 112 is negatively polarized corresponding to the voltage of the gate line (Gn−1) 113 on the preceding stage. The voltage Vg2 of the gate electrode of the transistor (Tr2) 107 that connects and disconnects the second voltage applying means is negative against the voltage of the gate line (Gn−1) 113 on the preceding stage. Thus, the transistor (Tr2) 107 is turned off. Consequently, since the pixel voltage Vp is not applied to the second signal line (Vac) 109, the pixel voltage Vp is not adversely affected by the transistor 107 (Tr2).

When the pixel having an address (n, m) of the display apparatus is selected and a display signal is written therein, the voltage applied to the gate line (Gn) 102 is boosted and thereby the transistor (Tr1) is turned on. At this point, the voltage of the signal line (Sm) 104 becomes equal to the pixel voltage Vp. At this point, in addition to the pixel voltage Vp, the signal voltage is applied to the capacitor (C1) 111. Due to the capacitance division of the capacitor (C1) 111 and the capacitor (C2) 112, a voltage Vg2 is generated therebetween. Thus, when the voltage applied by the first voltage applying means is lower than a polarization inverting voltage Vc at which the polarization of the ferroelectric capacitor (C2) 112 is inverted, the polarization of the capacitor (C2) 112 is maintained.

When the following expression is satisfied, the ferroelectric capacitor (C2) 112 is not inversely polarized and the polarization is maintained.

$$\Delta Vg2=(C1/(C1+2)\cdot\Delta Vsig<Vc$$

where ΔVsig is the maximum variation amount of the display signal voltage applied by the first voltage applying means in the normal driving mode.

Electric charge is stored in the liquid crystal 105, the capacitor (C1) 111, and the capacitor (C2) 112, which are connected in series. Although the ferroelectric capacitor (C2) 112 has a DC voltage, the normal dielectric capacitor (C1) 111 prevents the influence of the DC component against the pixel voltage Vp. When a signal is applied to the liquid crystal 105 so that the pixel voltage Vp becomes positive and negative to the opposite electrode voltage Vcom, an AC voltage can be applied to the liquid crystal 105. The amplitude of the signal can be freely assigned with a voltage applied to the signal line (Sm) 104. Thus, the transmissivity of the liquid crystal can be successively varied. Consequently, the gradation display can be performed.

Next, the memory driving mode will be described.

FIGS. 4A, 4B, 4C, and 4D provide schematic diagrams showing an example of a signal waveform in the memory driving mode. In the memory driving mode, the second voltage applying means applies an AC voltage such as an opposite voltage Vcom to the line Vac. When the frequency is set to 60 Hz, the user does not suffer from flickering. When necessary, the frequency can be varied.

Figure 4A:
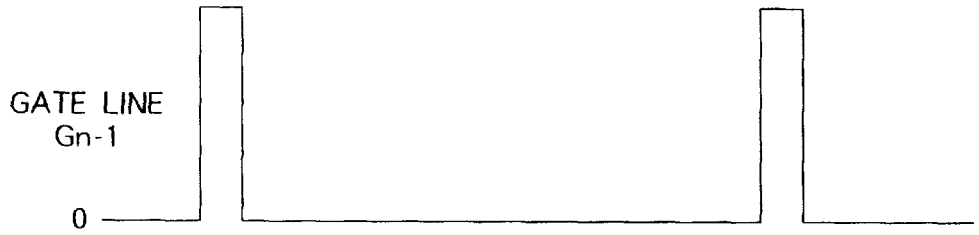
FIGS. 4A, 4B, 4C, and 4D provide is a schematic diagram showing an example of a applied signal of the liquid crystal display apparatus according to the present invention.
Figure 4B:
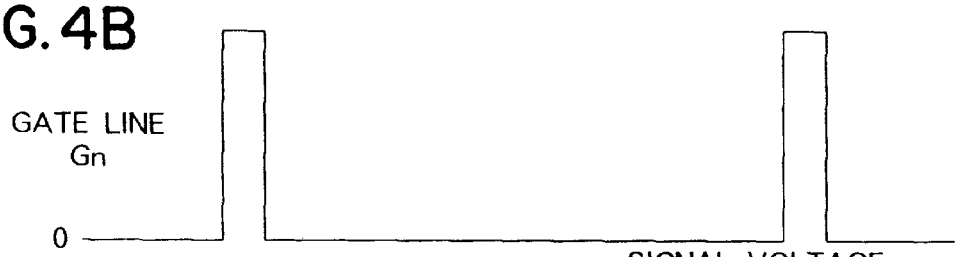
Figure 4C:
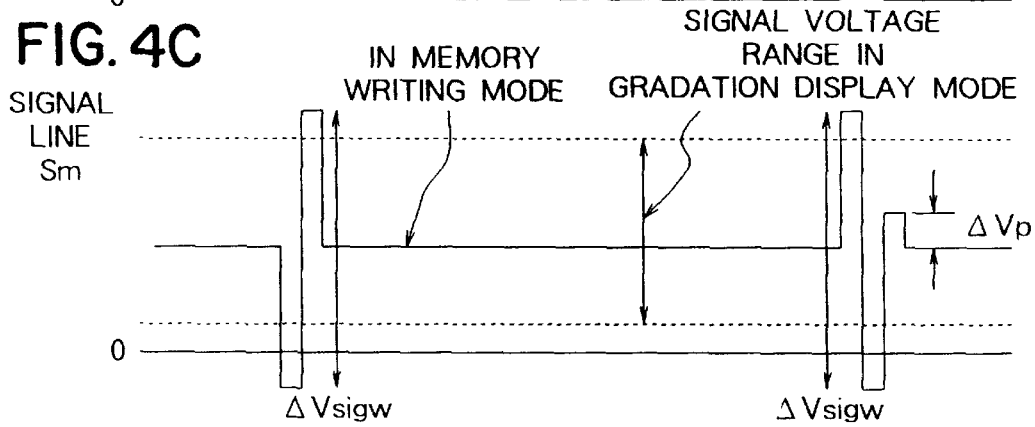
Figure 4D:
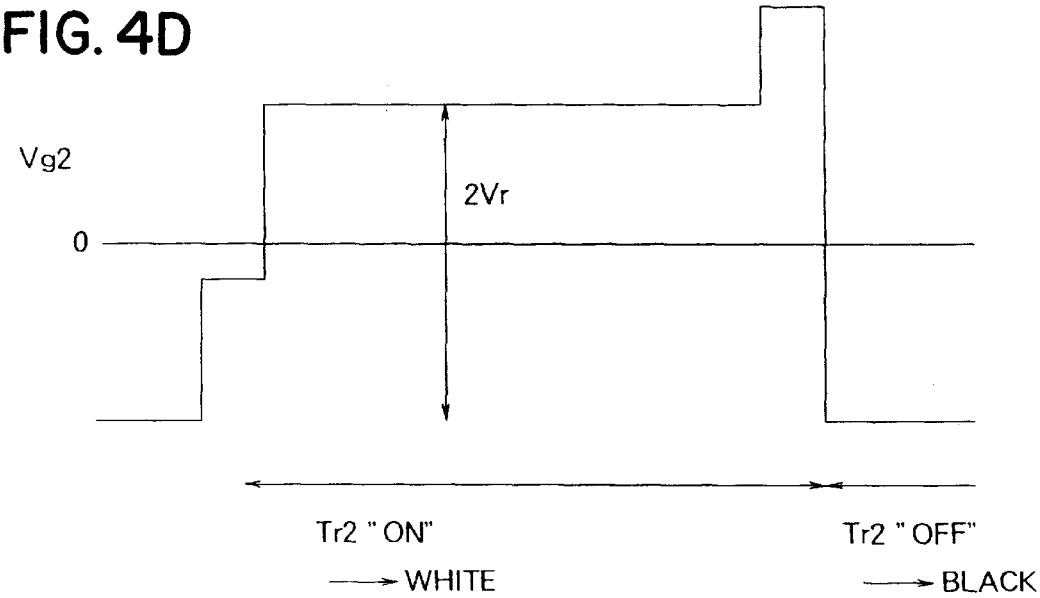

A positive pulse is applied to the gate line (Gn) 102 so as to turn on the transistor (Tr1) 101. In addition, a positive voltage amplitude ΔVsigw that is larger than that of the normal gradation display mode is applied to the signal line (Sm) 104. Thus, the orientation of the polarization on the Vg2 side of the ferroelectric capacitor (C2) 112 becomes positive against the gate line (Gn−1) 113 on the preceding stage. Alternatively, as shown in FIG. 4B, after the voltage Vp is decreased, a positive pulse may be applied to the gate line (Gn) 102. As another method, after a low voltage is applied in a frame, a high voltage that causes the polarization to be inversed is applied in the next frame.

In other words, when ΔVsigw is larger than the polarization inversing voltage Vc so that the following expression is satisfied, the polarization of the ferroelectric capacitor (C2) 112 is positively inverted.

$$\Delta Vg2=(C1/(C1+C2))\cdot\Delta Vsig>Vc$$

When the polarization of the ferroelectric capacitor (C2) 112 is positively inverted, since the voltage of the gate line (Gn−1) 113 on the preceding stage is already 0 V, ΔVg2 is nearly obtained by the following expression.

$$\Delta Vg2=(Pr\cdot A)/C2$$

where Pr is the residual polarization of the ferroelectric capacitor (C2) 112; A is the area of the capacitor; and C2 is the capacitance of the ferroelectric capacitor.

The voltage applied by the first voltage applying means causes the second transistor (Tr2) 107 to be turned on. Thus, the AC voltage applied to the second signal line (Vac) is applied to the liquid crystal through the second transistor (Tr2) 107. Thus, the liquid crystal is displayed in white.

In the state that the voltage applied by the first voltage applying means is positive, when a negative pulse corresponding to ΔVsigw is applied, a voltage larger than Vc as an absolute value is applied to the ferroelectric capacitor (C2) 112. Thus, the polarization of the ferroelectric capacitor (C2) 112 is inverted.

Thereafter, while the gate pulse is high, a voltage equal to the opposite electrode voltage Vcom is applied from the first voltage applying means. When the gate pulse is turned off (namely, the transistor (Tr2) 107 is turned off), the pixel voltage Vp becomes nearly equal to Vcom. Thus, a voltage is not applied to the liquid crystal. Thus, the liquid crystal is displayed in black. Alternatively, the voltage applied by the first voltage applying means may be larger than the opposite electrode voltage Vcom for the voltage shift amount ΔVp that results from the variation of the gate voltage of the transistor (Tr1) 101. Thus, the voltage applied to the liquid crystal becomes nearly 0. As to the black display of the liquid crystal, if the pixel voltage Vp drifts due to an external influence of for example a drive signal of another pixel in the state that the transistor (Tr1) 101 and the transistor (Tr2) 107 are turned off, when necessary, a voltage nearly equal to the opposite electrode voltage Vcom may be applied by the first voltage applying means. In this case, as with the normal gradation driving mode, since the polarization of the ferroelectric capacitor (C2) 112 is not inverted, the on/off state of the transistor (Tr2) 107 can be maintained.

As for the timing, while a still picture is being displayed, such a voltage may be applied once or more times per second. Even while a moving picture is being displayed, the voltage may be applied at a frequency of for example 60 Hz. The frequency of the voltage being applied can be varied corresponding to the required picture quality.

In addition, since all gate pulses can be turned on and written at the same time, the voltage can be applied in an idle time of which the display picture does not change. When necessary, the voltage can be applied at proper intervals. The voltage does not adversely affect the display.

In addition, since the voltage applied to the liquid crystal by the second voltage applying means is an AC voltage Vac applied to the second signal line, the voltage applied to the signal line (Sm) 104 varies only when the screen is rewritten. Thus, the effective frequency can be remarkably decreased. Consequently, the power consumption can be decreased to around zero.

In the case that the dielectric constant is 10 and the cell gap is 5 μm, the capacitance Ct of the liquid crystal of an A4-size liquid crystal display apparatus is 1.1 μF. Even if the frequency of the AC voltage applied by the second voltage applying means is 60 Hz and the driving voltage is 10 V, the power consumption is $1.1\ \mu F\times 60\times 10^2=6.6$ mW. This power consumption is on the order of which the liquid crystal display apparatus can be operated for more than several hundred hours with one alkaline AA-size dry battery. In particular, the liquid crystal display apparatus has satisfactorily low power consumption that is most suitable for a display apparatus for portable information units and so forth.

The gradation driving display mode by the first voltage applying means and the memory driving display mode by the second voltage applying means can be manually switched by the user. Alternatively, these modes can be automatically switched depending on the variation of the display screen.

As described above, the normal gradation driving display mode is performed with a voltage applied to the liquid crystal by the first voltage applying means, while the memory driving display mode is performed with a voltage at a frequency of for example 60 Hz that is lower than that of the first voltage applying means by the second voltage applying means. Thus, the driving frequency of the display signal applied to the first signal line can be markedly decreased. Consequently, the power consumption can be markedly reduced. In addition, when necessary, the gradation driving display mode can be used. Thus, the display quality is not deteriorated.

Figure 5:
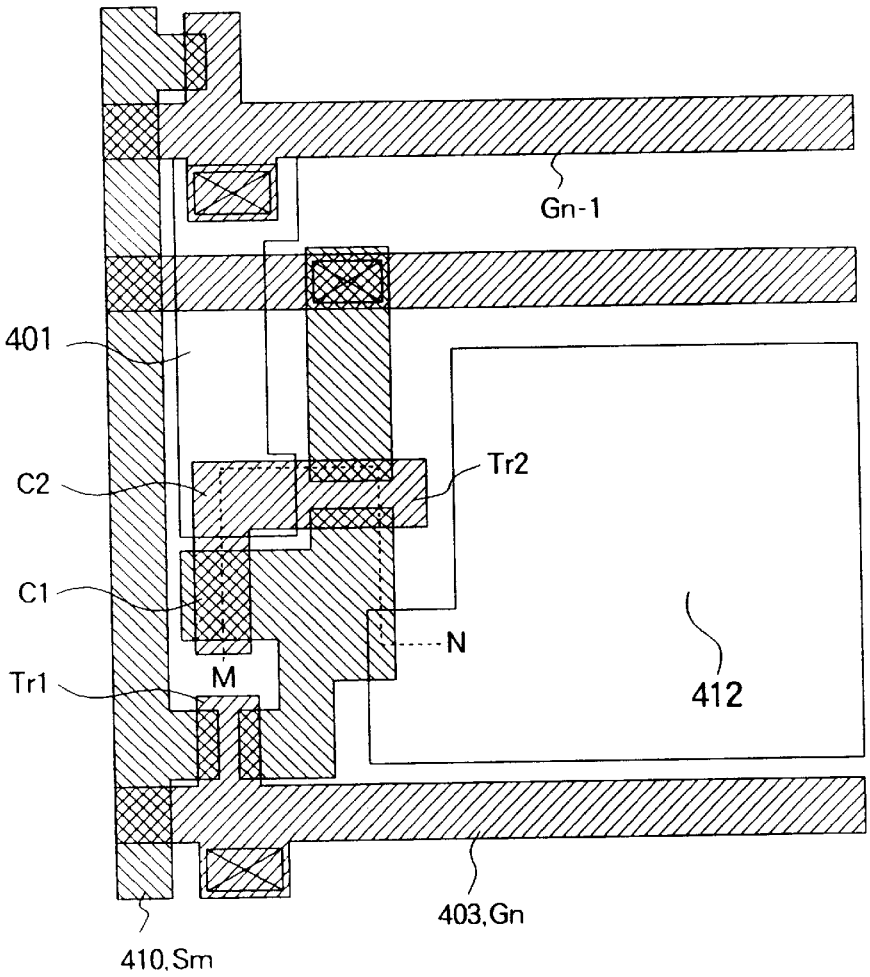
FIG. 5 is a schematic diagrams showing an example of a structure of a pixel portion of the liquid crystal display apparatus according to the present invention.
Figure 6:
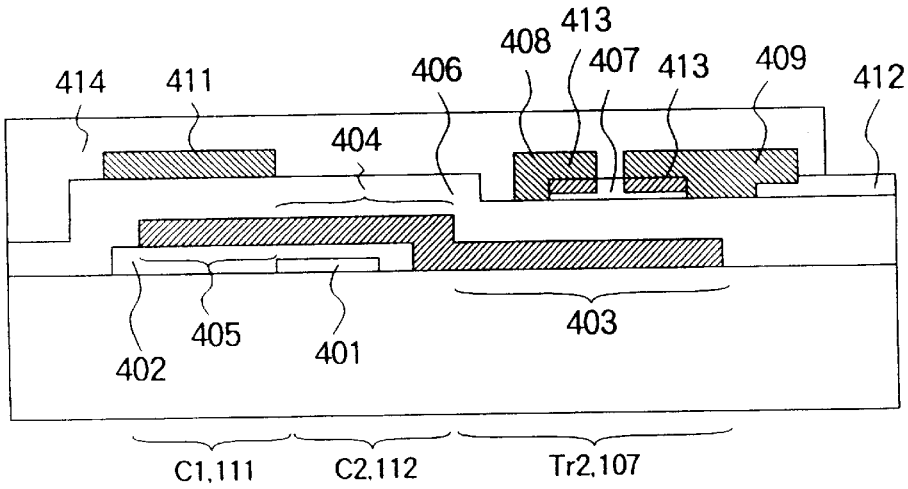
FIG. 6 is a sectional view taken along line MN of the pixel portion of FIG. 5.

FIG. 5 is a schematic diagram showing a pixel pattern for accomplishing the circuit shown in FIG. 2. FIG. 6 is a sectional view taken along line MN of FIG. 5.

After a lower electrode 401 is formed of an oxide conductor film such as ITO, a ferroelectric thin film 402 is deposited thereon. In this example, the ferroelectric thin film 402 was deposited for 200 nm at a substrate temperature of 600° C. by the CVD method. The ferroelectric film was present in the vicinity of a capacitor (C2) 112. However, the ferroelectric film may be present on the entire surface of the substrate. The ferroelectric thin film may be formed by the plasma CVD method. Alternatively, the ferroelectric thin film may be formed by the spatter method, ion assist method, or sol-gel method. As another method, the ferroelectric thin film may be formed by the laser annealing method. An example of the ferroelectric substance may be barium titanate, PZT, PLZT, or an organic film.

A gate line 403, an upper electrode 404 of the ferroelectric capacitor (C2) 112, and a lower electrode 405 of the normal dielectric capacitor (C1) 111 were formed of the same metal material. In this case, they were formed of MoW alloy with a thickness of 300 nm. The metal material may be MoTa or a single metal.

Thereafter, a gate insulation film 406 was deposited by the plasma CVD method. Next, amorphous silicon 407 was deposited. A source electrode 408, a drain electrode 409, a signal line 410, and an upper electrode 411 of the normal dielectric capacitor (C1) 111 that are composed of Mo were formed through an n-channel type amorphous silicon 413 of the source and drain regions.

Alternatively, the n-channel type amorphous silicon may be formed by the CVD method. As another method, the n-channel type amorphous silicon may be formed by doping impurity ions to amorphous silicon. With a mask of the gate electrode, the channel layer and the source and drain electrodes may be formed by the back-side exposing method using the self-aligning technique.

After an inter-layer insulation film was formed, the pixel electrode 412 was formed of ITO. The structure of the insulation film in the channel portion is effective for the self-aligning technique.

In this example, the transmitting type liquid crystal display apparatus was explained. However, the present invention can also be applied to a reflection type liquid crystal display apparatus. In this case, the pixel electrode is formed as a reflecting electrode that has a scattering property such as A1. When the pixel electrode is formed on the protection insulation film 414 in such a manner that it coats the lines and TFT, the aperture ratio will be improved.

The liquid crystal display apparatus according to the present invention may be fabricated in another method that has not been explained above.

Stagger type transistors or planar type transistor of which the gate electrode is formed on the semiconductor layer may be used. The semiconductor layer may be formed of non-single crystal silicon, CdSe, Te, or the like.

The liquid crystal may be other than GH type liquid crystal. Namely, the liquid crystal may be TN type liquid crystal, antiferroelectric liquid crystal, cholesteric liquid crystal, or the like. In the above-described example, the normally black mode was used. Instead, the normally white mode may be used. In addition, modifications of the present invention can be made in the scope thereof.

The circuit shown in FIG. 2B is valid when the relation of C1>C2 is satisfied, where C1 is the capacitance of the normal dielectric capacitor and C2 is the capacitance of the ferroelectric capacitor. In particular, in the relation of C1>>C2, the voltage change between the gate line Gn−1 and the pixel electrode 110 is almost applied to the capacitor C2. When the voltage change exceeds Vc, the polarization is inverted. Thus, the voltage is charged to the capacitor C1 through the capacitor C2. Consequently, the voltage across both terminals of the capacitor C1 varies, thereby determining the gate voltage of the transistor (Tr2). The capacitor C2 functions as a switch that is turned on when the voltage exceeds a predetermined value. Thus, the circuit shown in FIG. 2B operates in the same manner as the circuit shown in FIG. 2A.

Figure 7A:
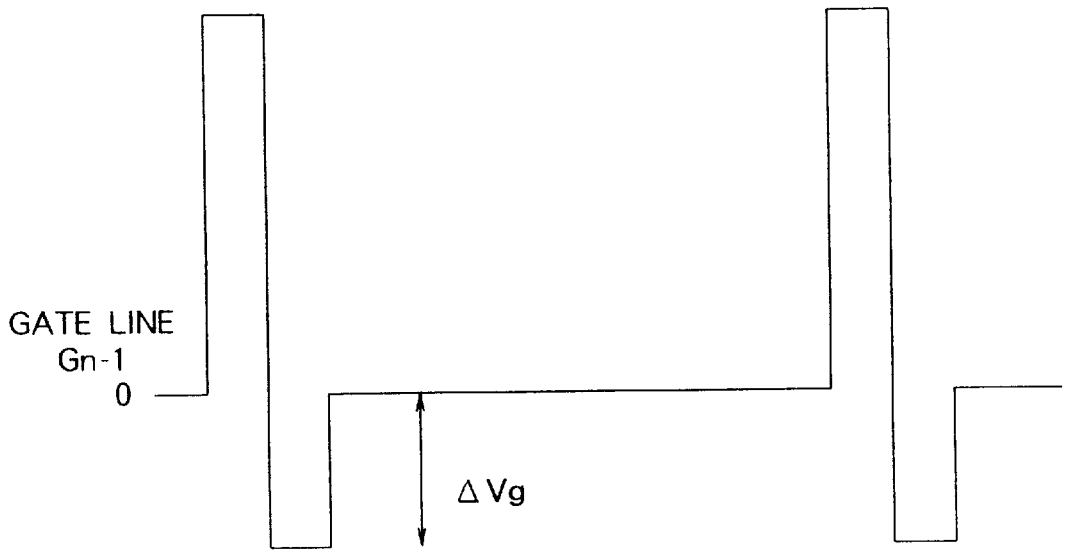
FIGS. 7A and 7B provide is a schematic diagrams showing another example of the applied signal of the liquid crystal display apparatus according to the present invention.
Figure 7B:
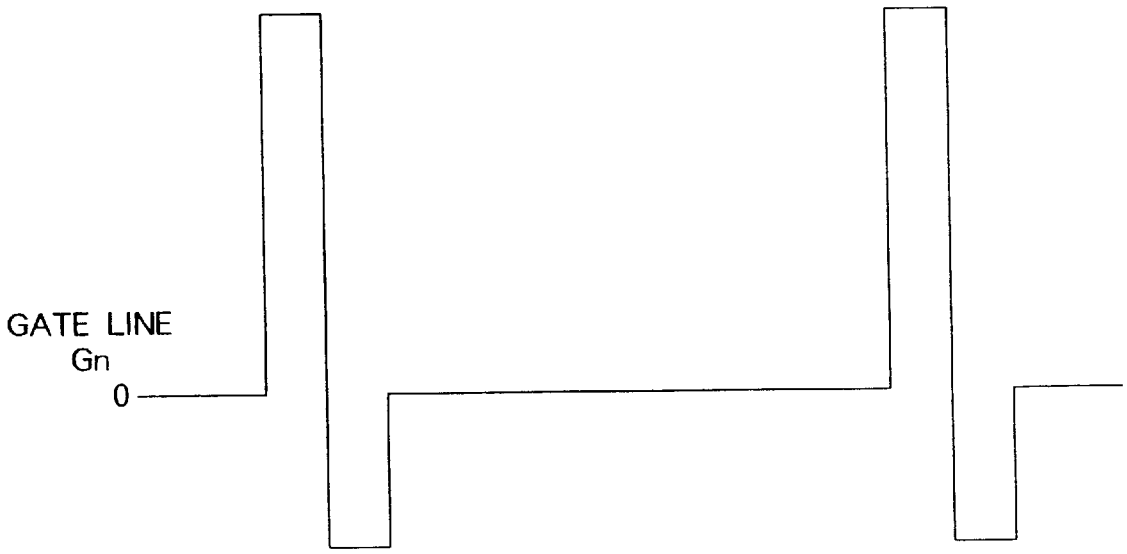

FIGS. 7A and 7B provide a waveform of a voltage applied in the case of a modification of the driving method in the circuit shown in FIG. 1. In this case, specific waveform of a pulse applied to the gate line is obtained in the memory driving mode. A pulse of the gate line on the preceding stage has three values. In the state that the transistor (Tr2) 107 of a selected pixel is turned on, when the voltage of the gate line on the preceding stage is decreased, the polarization of the ferroelectric capacitor (C2) 112 can be inversed with a low signal voltage. In addition, after the pixel has been selected, when the voltage of the gate line on the preceding stage is increased for ΔVg, the voltage of Vg2 is increased for ΔVg.

When the transistor (Tr2) 107 is turned on, the greater the positive gate voltage is, the smaller the on-resistance is. Thus, even if the size of the transition (Tr2) 107 is small or the mobility of the transistor is small, a voltage can be applied to the liquid crystal.

When the transistor (Tr2) 107 is turned off, the gate voltage Vg2 is in the range from 0 to −5 V. Thus, since it is not necessary to apply the same voltage with the reverse polarity as an absolute value, even if the voltage is higher than the voltage that results from the polarization of the ferroelectric capacitor (C2) 112 for ΔVg, the transistor (Tr2) can be satisfactorily turned off.

The above description was made for the n-channel type transistors. However, it can be applied to p-channel type transistors. In this case, the voltages should comply with the p-channel type transistors.

In the embodiment, the voltage of the opposite electrode is constant. Alternatively, the voltage applied to the line (Vac) may be constant and an AC voltage may be applied as the opposite electrode voltage Vcom. In this case, the line (Vac) can be connected to the gate line (Gn−1) 113 on the preceding stage.

In addition, an independent line connecting the ferroelectric capacitor (C2) 112 or normal dielectric capacitor (C1) 111 can be formed instead of the gate line on the preceding stage.

Figure 15:
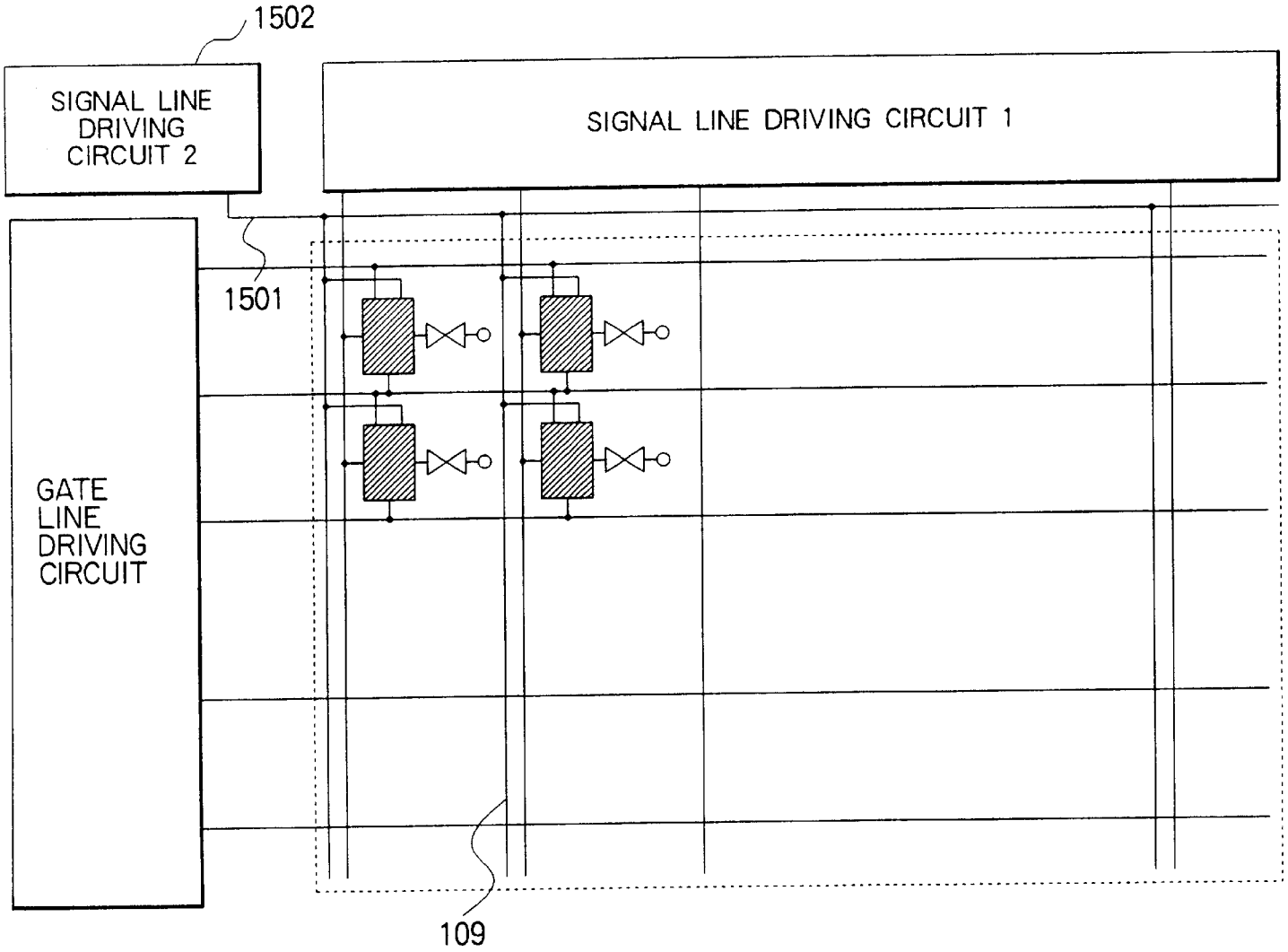
FIG. 15 is a schematic diagram showing another example of the structure of the liquid crystal display apparatus according to the present invention.

The line (Vac) 109 may be disposed in parallel with the signal line (see FIG. 15). This disposition is especially effective when a pixel electrode and a signal line of a reflecting type liquid crystal display apparatus or the like are formed as different layers that are insulated.

The first voltage applying means, the second voltage applying means, and the controlling means of the liquid crystal display apparatus according to the present invention can be accomplished with other than the circuit shown in FIGS. 2A and 2B.

Figure 8:
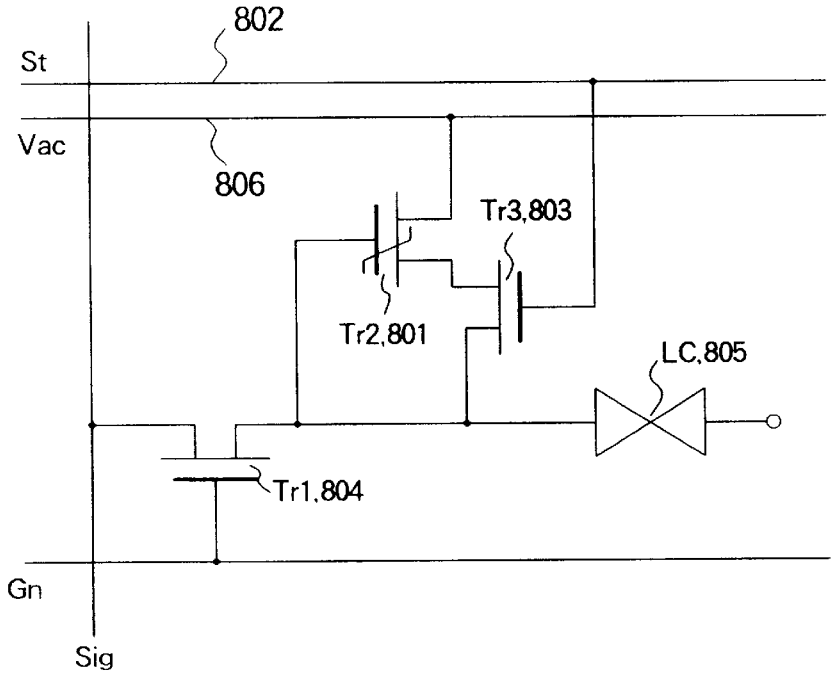
FIG. 8 is a schematic diagram showing another example of the structure of the pixel circuit of the liquid crystal display apparatus.

FIG. 8 is a schematic diagram showing another example of the circuit that composes one pixel of the liquid crystal display apparatus according to the present invention.

The pixel circuit shown in FIG. 8 comprises a thin film transistor (Tr2) 801 having a ferroelectric film formed between a gate electrode and a semiconductor film that connects a source electrode and a drain electrode through a contact region. In other words, the transistor (Tr2) 801 is a transistor of which a ferroelectric substance is used for a part of an insulation film (namely, the transistor has a ferroelectric capacitor). Thus, the transistor (Tr2) is a composite device that has a switching function and a memory function. Next, the transistor (Tr2) will be described in detail (see FIGS. 16 to 18).

When the polarization of the transistor (Tr2) 801 is inverted and the memory writing operation is performed, a transistor (Tr3) 803 is turned off through a strobe line (St) 802. When a positive polarization inversing voltage is applied by the first voltage applying means, a transistor (Tr1) 804 is turned on.

When the transistor (Tr3) 803 is turned on through the strobe line and the transistor (Tr2) 801 is turned on and off, the voltage of the second signal line (Vac) 806 is applied. Thus, the voltage is applied to a liquid crystal (LC) 805 in the memory driving mode.

In the circuit shown in FIG. 8, the transistor (Tr3) 803 and the strobe line (St) 802 may be omitted.

In this case, when the amplitude ΔVsigw of the signal applied from the first voltage applying means that inverses the polarization of the ferroelectric capacitor of the transistor (Tr2) 801 is increased and time is shorten, even if the transistor (Tr3) 803 and the strobe line (St) 802 are omitted, the ferroelectric capacitor can be operated as a switch.

Figure 9:
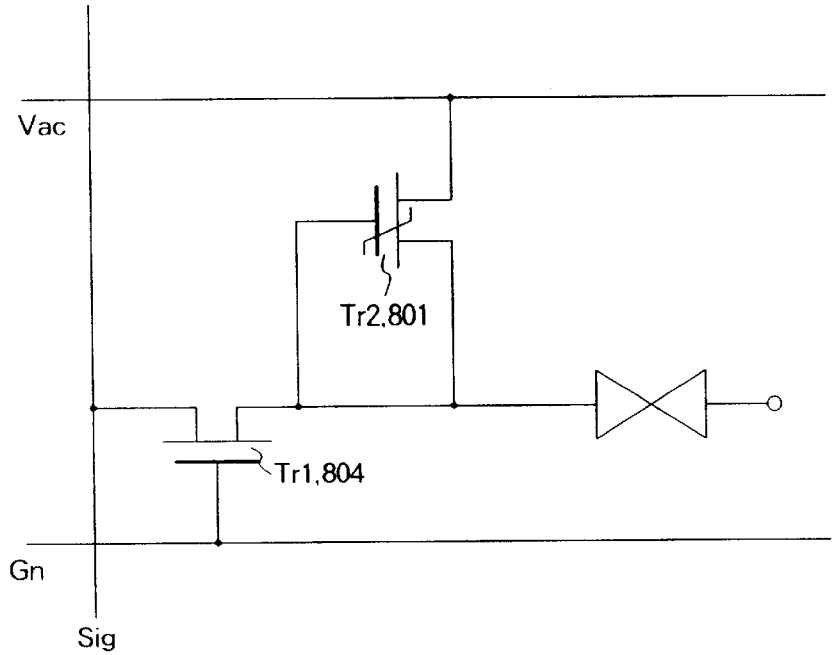
FIG. 9 is a schematic diagram showing another example of the structure of the pixel circuit of the liquid crystal display apparatus according to the present invention.

FIG. 9 is a schematic diagram showing an example of the structure omitting the transistor (Tr3) 803 and the strobe line (St) 802 of a pixel circuit of the liquid crystal display apparatus according to the present invention.

In the circuits shown in FIGS. 8 and 9, a transistor that has a ferroelectric capacitor as with the transistor (Tr2) may be constructed by a combination of a normal transistor 1001 and a ferroelectric capacitor 1002.

Figure 10:
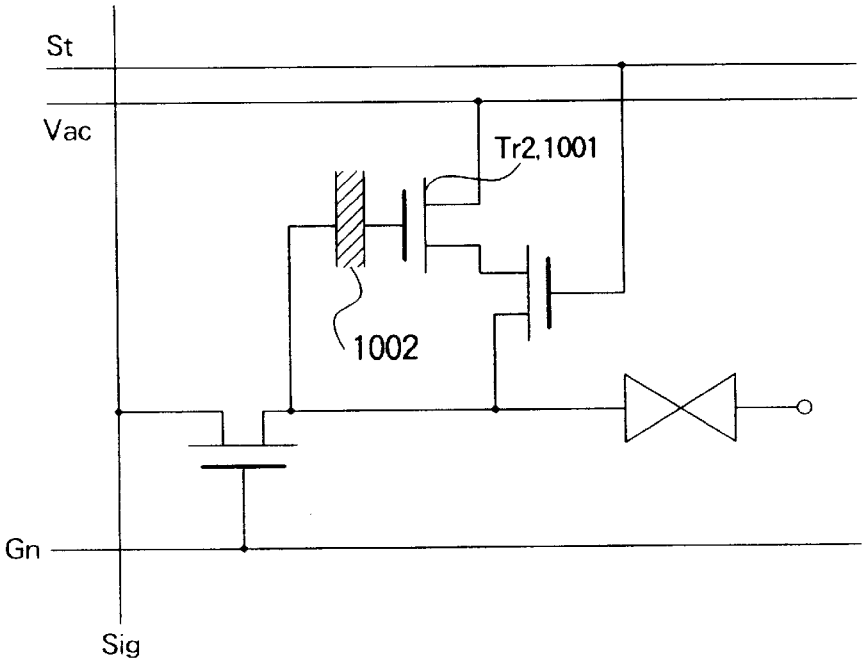
FIG. 10 is a schematic diagram showing another example of the structure of the pixel circuit of the liquid crystal display apparatus according to the present invention.
Figure 11:
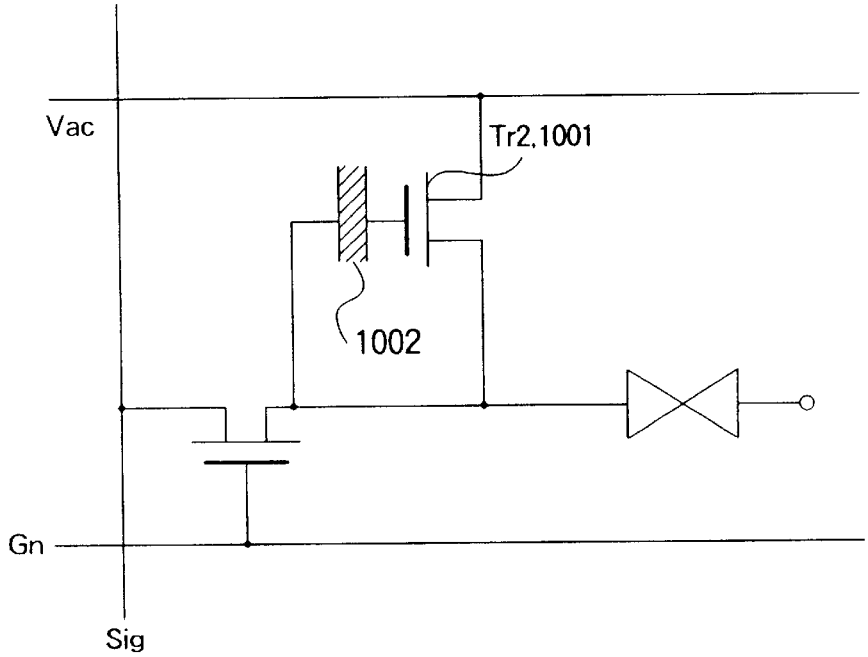
FIG. 11 is a schematic diagram showing another example of the structure of the pixel circuit of the liquid crystal display apparatus according to the present invention.

FIG. 10 is a schematic diagram showing a modification of the circuit shown in FIG. 8. In this modification, the circuit shown in FIG. 8 is composed of the normal transistor 1001 and the ferroelectric capacitor 1002. FIG. 11 is a schematic diagram showing the similar modification of the circuit shown in FIG. 9.

In the liquid crystal display apparatus according to the present invention, a voltage is applied to the liquid crystal by a plurality of systems of voltage applying means so as to accomplish the gradation display mode and memory display mode. In addition, a memory portion that switches the voltage applying means from one to another and has a memory that stores the switched state. Thus, the present invention can be accomplished in various circuit structures.

Next, another embodiment of the present invention will be described.

Figure 12:
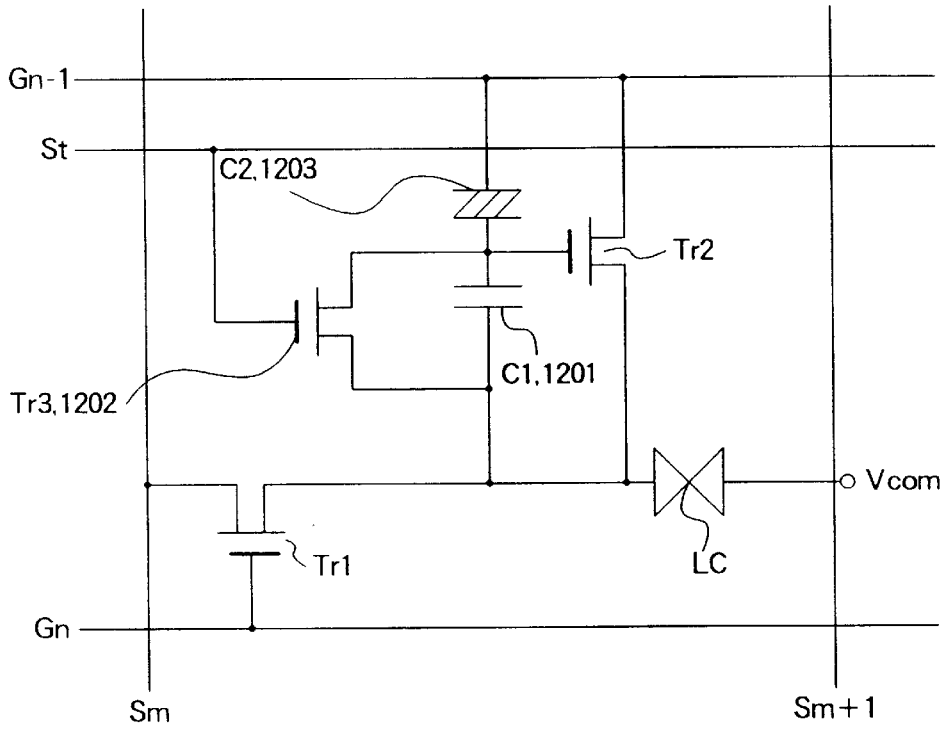
FIG. 12 is a schematic diagram showing another example of the structure of the pixel circuit of the liquid crystal display apparatus according to the present invention.

FIG. 12 shows another example of the pixel circuit of the liquid crystal display apparatus according to the present invention.

In this circuit, a transistor (Tr3) 1202 is disposed so that the source and drain thereof are connected in parallel with a normal dielectric capacitor (C1) 1201 shown in FIG. 2.

In this structure, when the transistor (Tr3) 1202 is turned on, the polarization of the ferroelectric capacitor (C2) 1203 is inverted. Thus, the polarization of the ferroelectric capacitor (C2) 1203 can be inverted with a low signal voltage.

In addition, the size of the ferroelectric capacitor (C2) 1203 can be increased in comparison with the size of the normal dielectric capacitor (C1). Thus, the storage capacitance of the transistor (Tr1) in the normal gradation driving mode becomes almost equal to the capacitance of the ferroelectric capacitor (C2) 1203. Consequently, the capacitance variation due to the applied voltage can be substantially removed. In addition, the gradation can be easily controlled.

Moreover, since the ferroelectric capacitor can be largely formed, the margin for fabricating the array substrate is improved. Thus, the entire display can be equally formed.

In addition, the productivity of the liquid crystal display apparatus can be improved.

Figure 13:
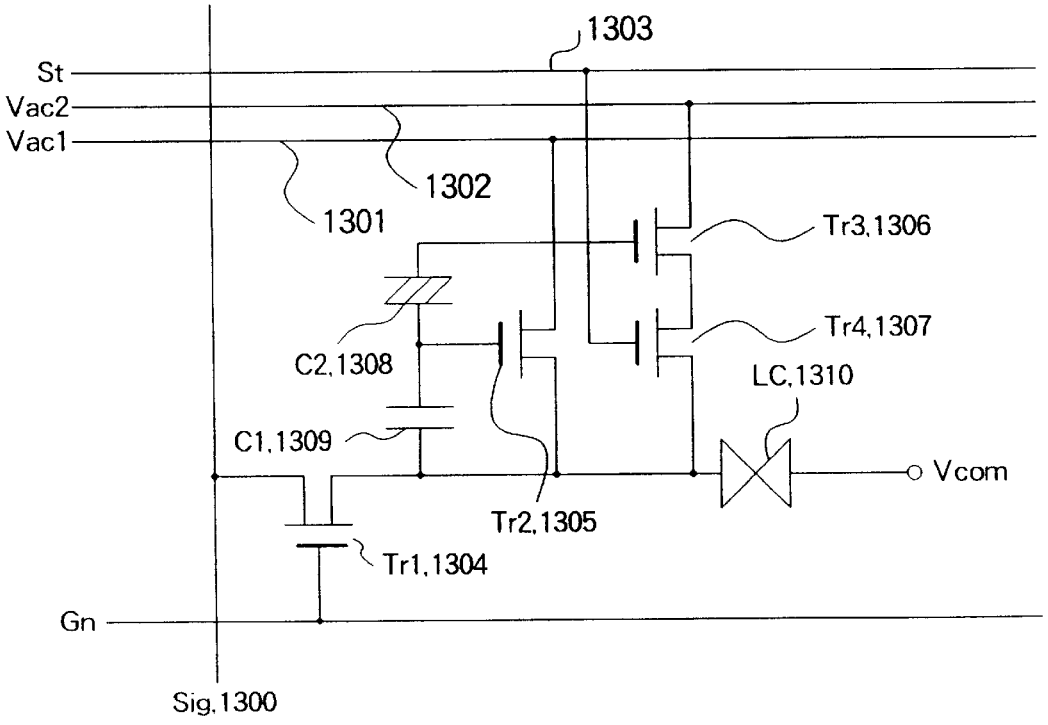
FIG. 13 is a schematic diagram showing another example of the structure of the pixel circuit of the liquid crystal display apparatus according to the present invention.

FIG. 13 is a schematic diagram showing another example of the pixel circuit of the liquid crystal display apparatus according to the present invention.

In this pixel circuit, besides a signal line (Sig) 1300 as the first voltage applying means, three systems of signal lines that are a second signal line (Vac1) 1301, a second signal line (Vac2), and a strobe line (St) 1303 are disposed as the second voltage applying means. Corresponding to these systems, four non-linear switching elements are disposed so as to switch the system from one to another and store the switched state. The four non-linear switching elements are a transistor (Tr1) 1304, a transistor (Tr2) 1305, a transistor (Tr3) 1306, a transistor (Tr4) 1307, a ferroelectric capacitor (C2) 1308, and a normal dielectric capacitor (C1) 1309.

A voltage is applied in such a manner that when the transistor (Tr2) 1305 is turned on, the transistor (Tr3) 1306 is turned off and that when the transistor (Tr2) 1305 is turned off, the transistor (Tr3) 1306 is turned on.

In the case that the gradation driving mode is performed, when the transistor (Tr4) 1307 is always turned off, the transistor (Tr2) 1305 is turned off, and the transistor (Tr3) 1306 is turned on, the second signal lines (Vac1) 1301 and (Vac2) 1302 can be disconnected from the liquid crystal (LC) 1310. Thus, the normal gradation display mode can be performed through the first signal line (Sig) 1300 and the transistor (Tr1) 1304.

In the case that the memory driving mode is performed, when the transistor (Tr4) 1307 is always turned on, the transistor (Tr2) 1305 is turned on, and the transistor (Tr3) 1306 is turned off, a voltage Vac1 is applied to the liquid crystal. When the transistor (Tr2) 1305 is turned off and the transistor (Tr3) 1306 is turned on, a voltage Vac2 is applied to the liquid crystal.

In this structure, even if the memory driving mode, in which the power consumption is remarkably reduced, is performed, a predetermined voltage Vac1 or Vac2 can be always applied to the liquid crystal (LC) 1310. Thus, the writing timing to the ferroelectric capacitor (C2) 1308 through the transistor (Tr1) 1304 can be freely selected. In addition, the refresh of the liquid crystal through the transistor (Tr1) 1304 can be completely maintained constant.

In the structure shown in FIG. 13, normal dielectric substance can be used for the capacitor (C2) 1308 and ferroelectric substance for the capacitor (C1) 1309.

Figure 14:
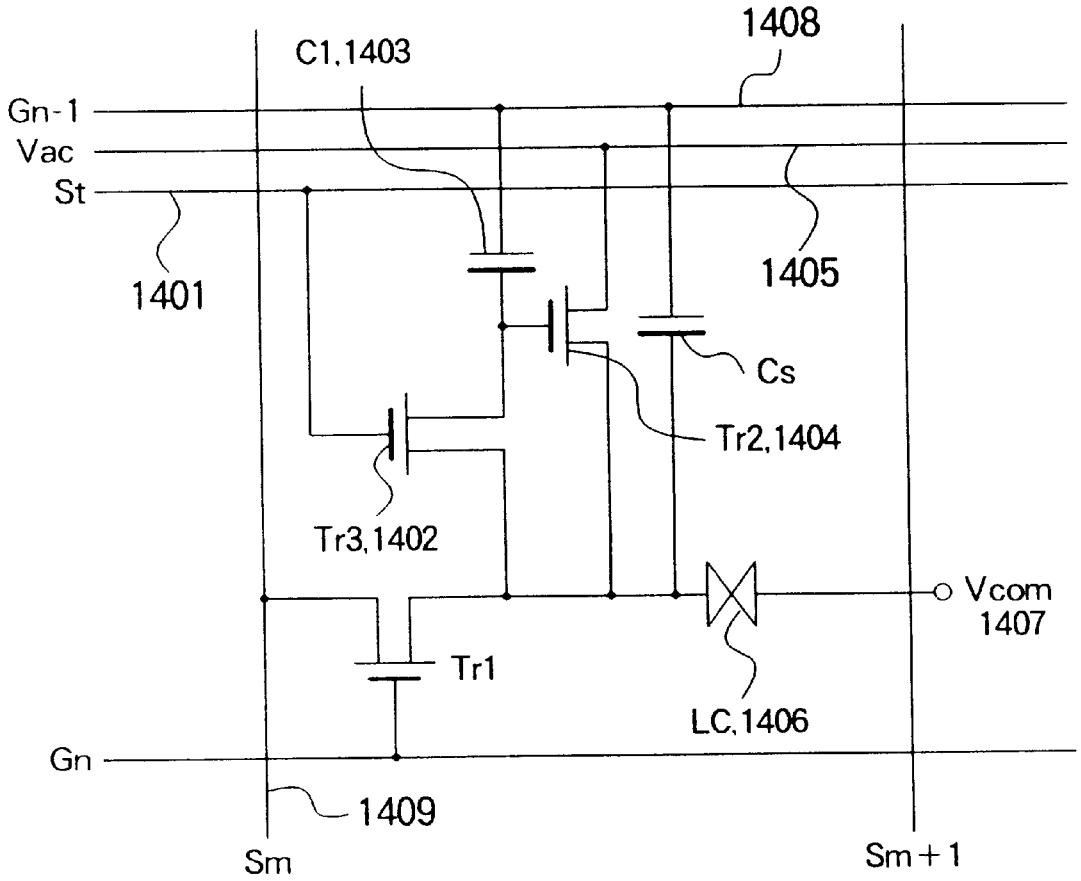
FIG. 14 is a schematic diagram showing another example of the structure of the pixel circuit of the liquid crystal display apparatus according to the present invention.

FIG. 14 a schematic diagram showing another example of the pixel circuit of the liquid crystal display apparatus according to the present invention.

In the pixel circuit shown in FIG. 14, a ferroelectric capacitor is not disposed. A transistor (Tr3) 1402, of which the gate electrode is connected to a strobe line (St) 1401, and a normal dielectric capacitor (C1) 1403 cause the display mode to be switched. The switched state is managed by a first signal line driving circuit through the strobe line (St) 1401.

When the transistor (Tr3) 1402 is turned on through the strobe line (St) 1401, a voltage is applied to the normal dielectric capacitor (C1) 1403. Thus, the transistor (Tr2) 1404 can be turned on and off. Consequently, a voltage Vac can be applied to the liquid crystal (LC) 1406 through the second signal line 1406.

As described earlier, when an AC voltage is applied to the opposite electrode (Vcom) 1407, the line (Vac) 1405 through which an AC voltage is applied to the liquid crystal (LC) 1406, can be shared with the strobe line (St) 1401 or the gate line (Gn−1) 1408.

In addition, the second signal line (Vac) 1405, which is the second voltage applying means, and the strobe line (St) 1401 may be formed in parallel with the first signal line (Sm) 1409.

When the pixel electrode and the signal line are formed as different layers that are insulated as with a reflecting type liquid crystal display apparatus, the above-described structure is particularly effective.

FIG. 15 is a schematic diagram showing an example of the above-described structure of the liquid crystal display apparatus. A plurality of systems of the second signal line may be disposed. In this case, a second signal line driving circuit 1502 that is a driving circuit of a second signal line 1501 (to which a display signal is not always applied) may be independently disposed for each system. Alternatively, one driving circuit that can control the individual systems may be disposed.

In the case that a constant voltage is applied to the line Vac, an AC voltage is applied to the opposite electrode Vcom, and the line Vac is shared with the strobe line (St) or the gate line (Gn−1) on the preceding stage, the opposite electrode driving circuit is provided with the same function as the second signal line driving circuit. Alternatively, the opposite electrode is driven by the second signal line driving circuit, as appropriate.

As a method for selecting Vac1 or Vac2, the circuit shown in FIG. 13 may be composed without a ferroelectric capacitor. For example, instead of the ferroelectric capacitor (C2) 1308 of the circuit shown in FIG. 13, an inverter circuit may be used.

Next, a non-linear switching element that has a ferroelectric film used in the liquid crystal display apparatus according to the present invention will be described.

Figure 16:
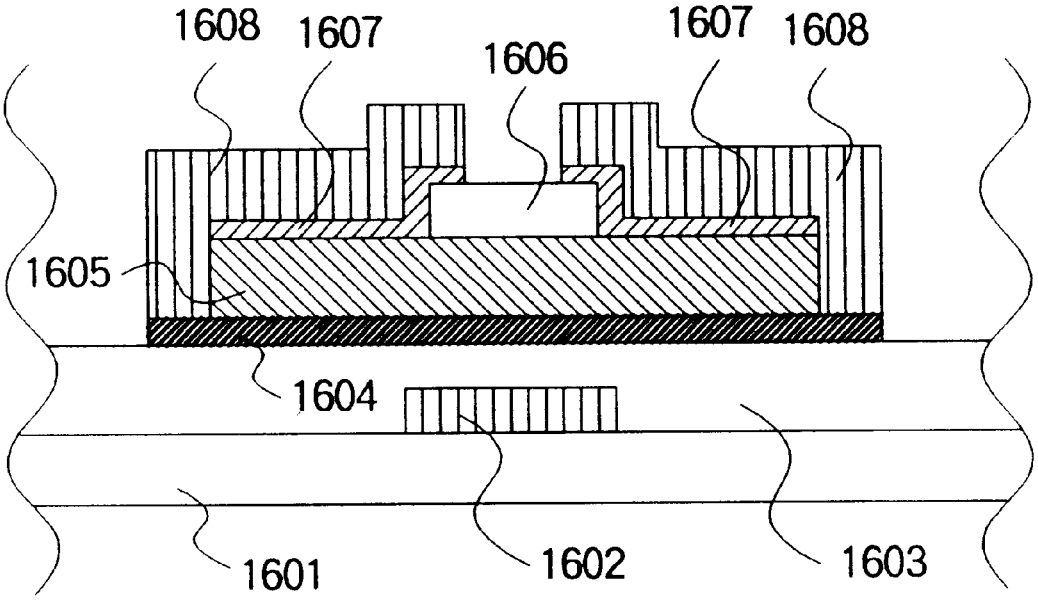
FIG. 16 is a schematic diagram showing an example of the structure of a thin film transistor of the liquid crystal display apparatus according to the present invention.
Figure 17:
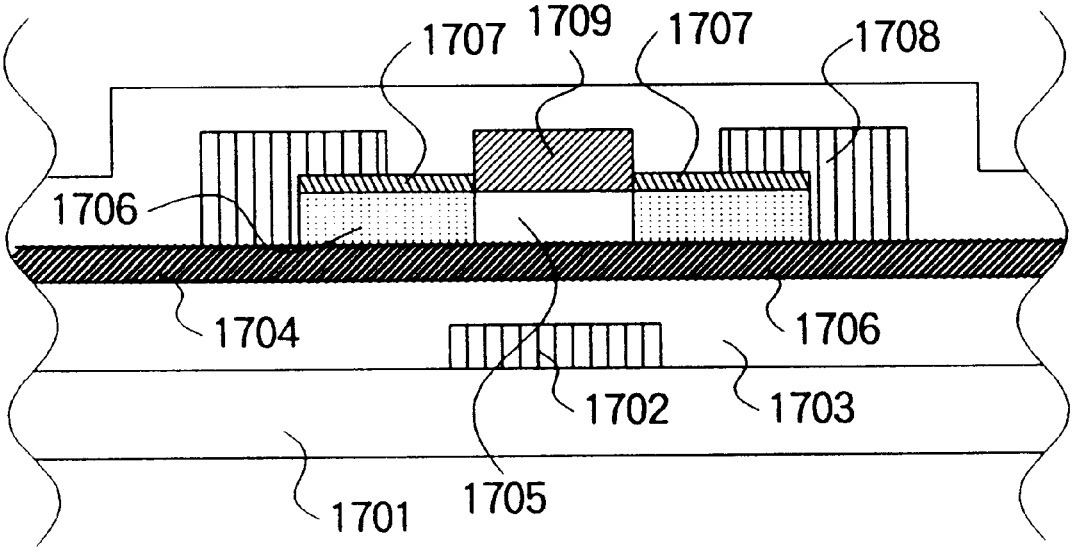
FIG. 17 is a schematic diagram showing an example of the structure of the thin film transistor of the liquid crystal display apparatus according to the present invention.
Figure 18:
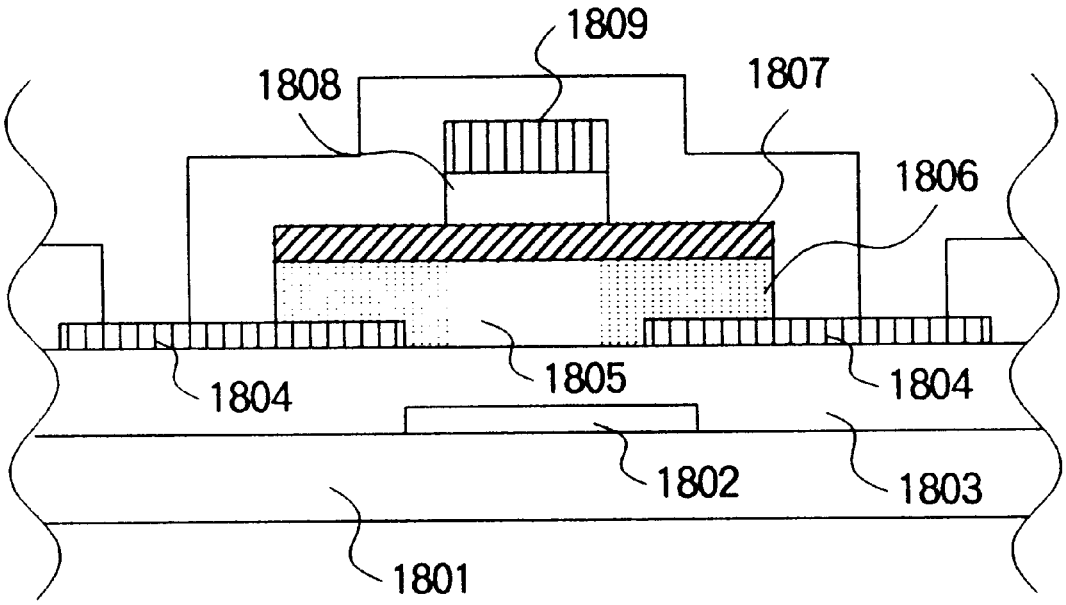
FIG. 18 is a schematic diagram showing an example of the structure of a thin film transistor of the liquid crystal display apparatus according to the present invention.

FIGS. 16, 17, and 18 are sectional views showing examples of the structures of thin film transistors that are composite devices having ferroelectric films formed in the pixel portions shown in FIGS. 8 and 9.

A thin film transistor shown in FIG. 16 comprises a transparent insulation substrate 1601, a gate electrode 1602 formed on the insulation substrate 1601, a gate insulation film 1603 formed on the gate electrode 1602, a ferroelectric film 1604 formed on the gate insulation film 1603, a semiconductor film 1605 formed on the ferroelectric film 1604, a channel protection film 1606 formed on the semiconductor film 1605, a plurality of impurity-doped semiconductor films 1607 formed on the semiconductor film 1605 through the channel protection film 1606, and a source/drain electrode 1608 formed on the impurity-doped semiconductor film 1607.

The ferroelectric film 1604 may be formed in the region of the semiconductor film 1605 and the source/drain electrode 1608.

In the thin film transistor shown in FIG. 16, the ferroelectric film 1604 is formed of a crystal film of barium titanate. The ferroelectric insulation film may be composed of a perovskite type ferroelectric substance such as PZT ($PbZr_xTi_{1-x}O_3$) or PLZT($(Pb, La)(Zr, Ti)O_3$). Alternatively, the ferroelectric insulation film may be formed of a compound such as $BaMgF_4$ or a layered compound such as $Ba_4Ti_3O_{12}$.

In addition, the ferroelectric insulation film may be formed of an organic ferroelectric substance such as a copolymer of vinylidene fluorite and trifluoro ethylene or a copolymer of poly(vinylidene fluoride) and trifluoro ethylene.

The ferroelectric insulation film may be formed by the spatter method, CVD method, plasma CVD method, ion assist method, or sol-gel method, as required. The film thickness of the ferroelectric insulation film may be selected corresponding to the required capacitance, or the like, as appropriate.

Moreover, a substrate protection film may be formed on the transparent insulation substrate 1601. A gate electrode 1602 may be formed on the substrate protection film.

The semiconductor film 1605 may be formed of for example amorphous silicon film or non-single crystal silicon film. Alternatively, the semiconductor film 1605 may be formed of another semiconductor such as CdSe or Te.

The thin film transistor shown in FIG. 17 comprises a transparent insulation substrate 1701, a gate electrode 1702 formed on the insulation substrate 1701, a gate insulation film 1703 formed on the gate electrode 1702, a ferroelectric film 1704 formed on the gate insulation film 1703, a semiconductor film 1705 formed on the ferroelectric film 1704, a contact region 1706 formed in a predetermined region of the semiconductor film 1705, a silicide layer 1707 formed on the contact region 1706, and a source/drain electrode 1707 formed on the silicide layer 1707.

The ferroelectric film 1704 may be formed on the entire surface of the gate insulation film 1703.

As was described above, the semiconductor film 1705 may be composed of a-Si, p-Si, $\mu$-Si, or another semiconductor.

A channel protection film 1709 may be formed on a channel region of the semiconductor film 1705.

Moreover, a passivation film 1710 may be formed over the source/drain electrode 1708 and the channel protection film 1709.

With a mask of the gate electrode 1702, the channel protection film 1709 is formed by the self-aligning technique. With a mask of the channel protection film 1709, phosphorus (P) ions (in the case of the n-channel type) are doped so as to form the contact region 1706 of the semiconductor film.

The silicide layer 1707 may be formed by depositing a metal such as Mo or Ni on the contact region 1706 of the semiconductor film 1705 and heating the resultant structure at a high temperature.

The thin film transistor as shown in FIG. 18 comprises a transparent insulation substrate 1801, a light insulation film 1802 formed on the insulation substrate 1801, an insulation film 1803 formed on the light insulation film 1802 and the insulation substrate 1801, a source/drain electrode 1804 formed on the insulation film 1803, a semiconductor film 1805 formed on the source/drain electrode 1804 and the insulation film 1803, an impurity-doped semiconductor layer 1806 formed at a predetermined region of the semiconductor film 1805 as a contact region, a ferroelectric film 1807 formed on the semiconductor film 1805, a gate insulation film 1808 formed in a region corresponding to the channel region of the semiconductor film 1805 on the ferroelectric film 1807, and a gate electrode 1809 formed on the gate insulation film 1808. After the impurity layer is ion-doped, it is activated by the laser annealing method.

The source/drain electrode 1804 may be formed with a mask of the light insulation film 1802 by the back-side exposing method using the self-aligning technique. In addition, the contact region 1806 of the semiconductor film may be patterned by the back-side exposing method. With a mask of the pattern, the contact region 1806 may be formed by the doping method.

The gate electrode 1808 and the source/drain electrode 1804 may be formed so that they overlay.

Besides the thin film transistors shown in FIGS. 16, 17, and 18, a ferroelectric film may be formed between a gate insulation film and a semiconductor film of another thin film transistor such as a planar type transistor.

In addition, the normal dielectric gate insulation films (1603, 1703, and 1808) may be omitted. Namely both the gate electrode (1602, 1702, 1809) and the semiconductor (1605, 1705, 1805) contact to ferroelectric film (1604, 1704, 1807) directly.

The thin film transistors that have the above-described structures function as composite devices of ferroelectric capacitor and thin film transistor. In other words, in the liquid crystal display apparatuses according to the present invention (see FIGS. 8 and 9), a switch function of a plurality of systems of voltage applying means that apply voltages to the liquid crystal and a memory function for accomplishing the memory driving mode can be satisfied at the same time. Thus, the liquid crystal display apparatuses that have such thin film transistors can switch the display mode from one to another (such as from the gradation driving mode to the memory driving mode or vice versa) and store the switched state. Thus, the power consumption can be remarkably reduced.

In addition, the electric charges of the ferroelectric substance can be easily stored without deterioration. Moreover, since the electric charges resulting from the polarization can be used for activating carriers in the semiconductor film. Thus, a liquid crystal display apparatus having a large amount of on-current in the thin film transistor and improved properties of the thin film transistor can be accomplished.

Figure 19A:
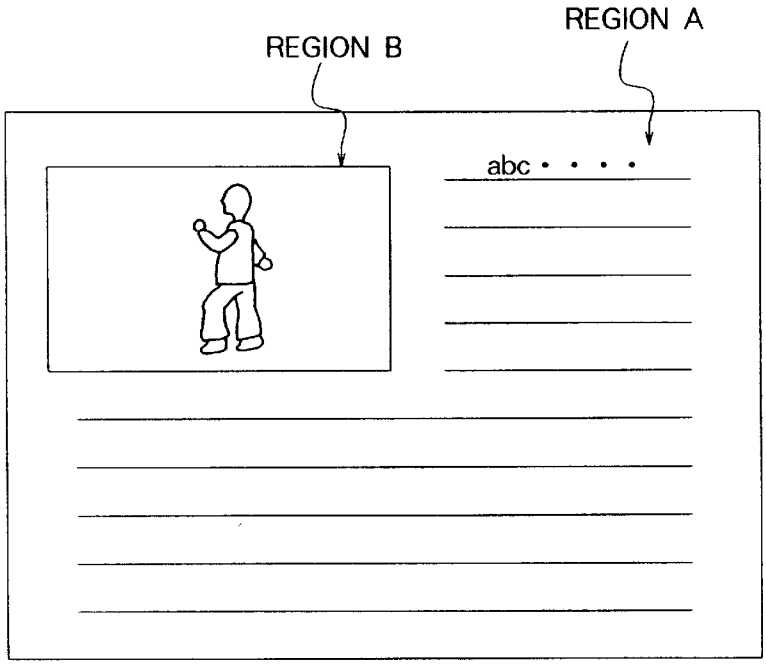
FIG. 19A is a schematic diagram showing a screen of the liquid crystal display apparatus according to the present invention.
Figure 19B:
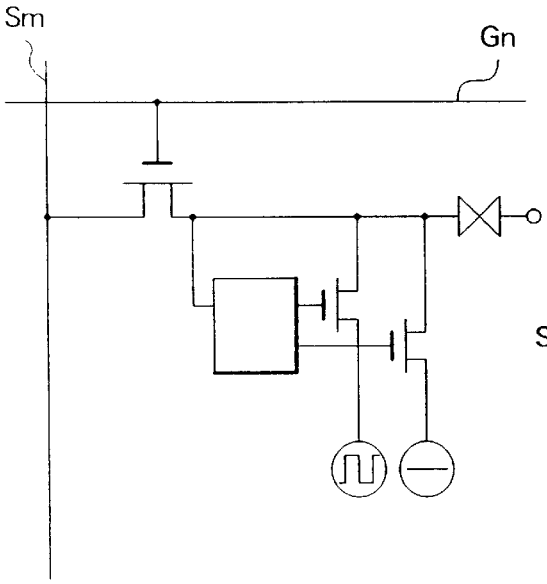
FIG. 19B is a schematic diagram showing another example of the structure of the pixel circuit of the liquid crystal display apparatus according to the present invention.
Figure 19C:
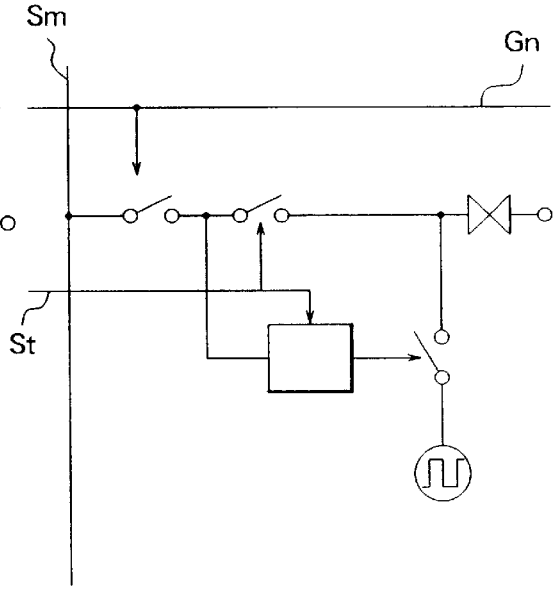
FIG. 19C is a schematic diagram showing another example of the structure of the pixel circuit of the liquid crystal display apparatus according to the present invention.

FIGS. 19A, 19B, and l9C are schematic diagrams for explaining the switching state of the memory portion. FIG. 19A shows the case that the state for selecting a signal voltage for each pixel or the state for sampling a signal voltage at the timing of which a scanning line is selected is switched so as to display a still picture (region A) with small gradation or a moving picture (region B) with large gradation on the same screen. The memory driving mode may be switched corresponding to a signal through the signal line as shown in FIG. 19B. Alternatively, the memory driving mode may be switched through a control line other than the signal line as shown in FIG. 19C.

Figure 20:
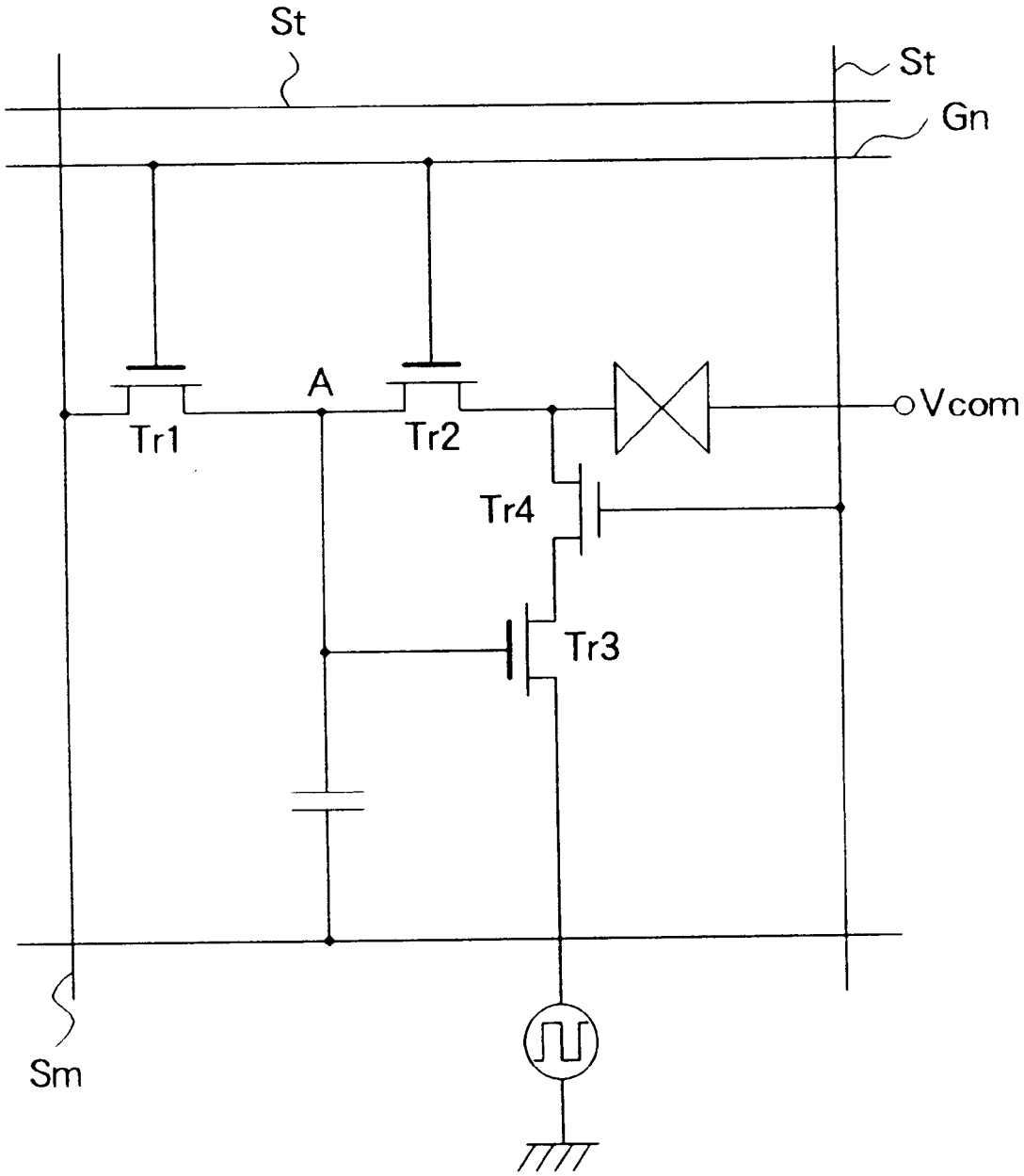
FIG. 20 is a schematic diagram showing an example of the pixel circuit of the liquid crystal display apparatus according to the present invention.
Figure 21:
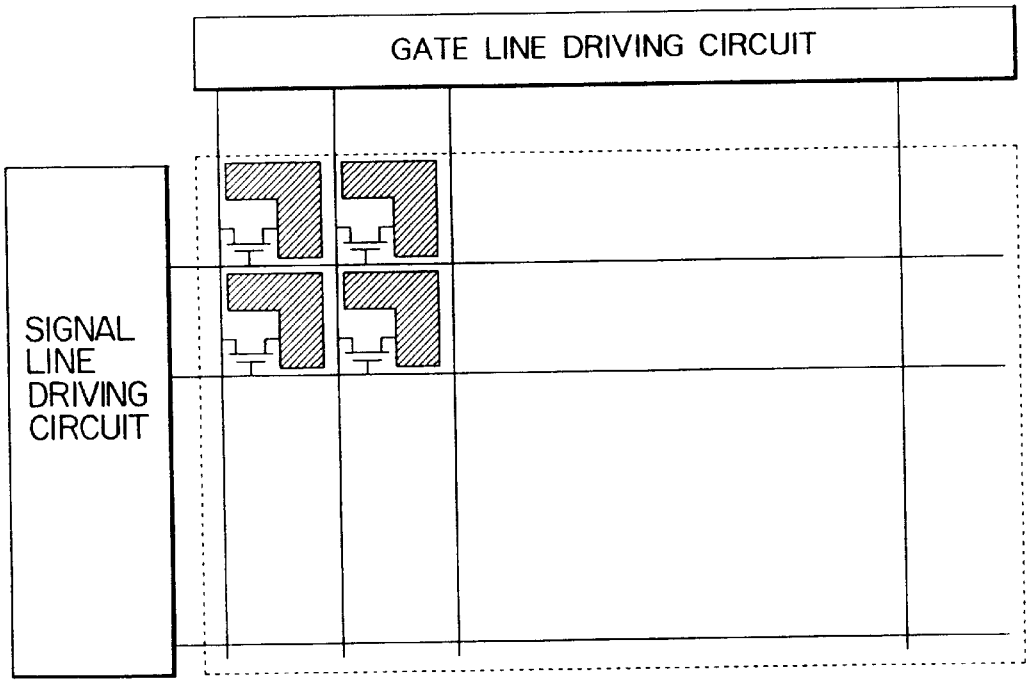
FIG. 21 (PRIOR ART)
FIG. 21 is a schematic diagram showing an example of the structure of a conventional liquid crystal display apparatus.
Figure 22:
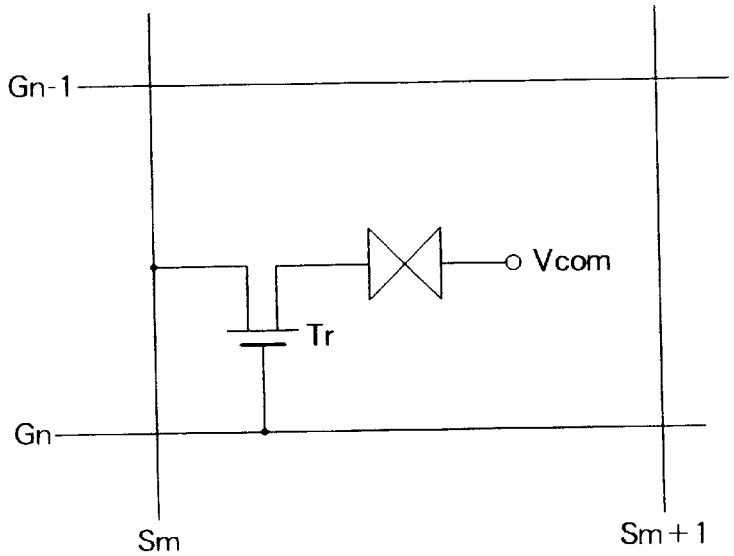
FIG. 22 (PRIOR ART)
FIG. 22 is a schematic diagram showing an example of a pixel circuit of the conventional liquid crystal display apparatus.

FIG. 20 shows the structure of a circuit that does not need to rewrite a signal in the case that the sampling state of the memory that stores the switched state is changed to the selecting state. The memory portion is composed of four transistors Tr1, Tr2, Tr3, and Tr4. The transistor Tr1 is connected to the signal line. The transistors Tr2 and Tr4 are connected to the strobe line St. The transistor Tr3 is connected to the AC signal source shared by all pixels. The transistor Tr3 may have a ferroelectric substance.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A liquid crystal display apparatus, comprising:

first voltage applying means for applying a first voltage at a first frequency to a liquid crystal, the first voltage applying means having at least one non-linear switching element and intersecting a scanning line so as to form a matrix, second voltage applying means for applying a second voltage at a second frequency to the liquid crystal, the second voltage applying means having at least one non-linear switching element and the second frequency being lower than the first frequency, and controlling means for switching the voltage applying means alternately, said controlling means having a memory portion for storing a switched state for switching between a sampling state and a selected state, wherein the sampling state samples the first voltage at a sampling timing and consequently applies a sampling voltage corresponding to the first voltage to the liquid crystal, and the selected state selects the second voltage.

2. The liquid crystal display apparatus as set forth in claim 1, wherein said first voltage applying means is supplied with time-divided information corresponding to a number of pixels included in the apparatus.

3. The liquid crystal display apparatus as set forth in claim 1, wherein said second voltage is in common with at least part of a display.

4. The liquid crystal display apparatus as set forth in claim 1, wherein the memory portion is composed of one memory for storing both the switched state and the selected state or two memories for storing the switched state and the selected state.

5. The liquid crystal display apparatus as set forth in claim 1, wherein the switched state is switched for a number of pixels included in the apparatus, and the selected state and the sampling state are assigned to a still picture portion and a moving picture portion, respectively.

6. The liquid crystal display apparatus as set forth in claim 1, wherein the switched state is categorized as one of a low power consumption mode and a high picture quality display mode, the selected state and the sampling state being assigned respectively to the low power consumption mode and the high picture quality display mode.

7. The liquid crystal display apparatus as set forth in claim 1, wherein the switched state is switched with one signal.

8. The liquid crystal display apparatus as set forth in claim 1, wherein the switched state is switched through a control line other than a signal line.

9. The liquid crystal display apparatus as set forth in claim 1, wherein rewriting of a signal from the selected state to the sampling state is not required.

10. The liquid crystal display apparatus as set forth in claim 1, wherein the memory portion is composed of a thin film transistor having a ferroelectric film disposed between a gate electrode and a semiconductor film for connecting a source electrode and a drain electrode through a contact region.

11. The liquid crystal display apparatus as set forth in claim 10, wherein the ferroelectric film is one selected from the group consisting of barium titanate, perovskite type substance, layered perovskite, a layered compound, metal oxide and an organic ferroelectric substance selected from the group consisting of a copolymer of vinylidene fluorite and trifluoroethylene and a copolymer of poly (vinylidene fluoride) and trifluorethylene.

12. The liquid crystal display apparatus as set forth in claim 1, wherein said first and second voltage applying means include different signal line driving circuits.

13. The liquid crystal display apparatus as set forth in claim 1, wherein said plurality of systems of voltage applying means apply voltages to an opposite electrode.

14. The liquid crystal display apparatus as set forth in claim 1, wherein said controlling means includes a non-linear switching element.

15. The liquid crystal display apparatus as set forth in claim 1, wherein each of the non-linear switching elements is a diode or an MIM (Metal-Insulator-Metal).

16. The liquid crystal display apparatus as set forth in claim 1, wherein said first and second voltage applying means include identical signal line driving circuits.

17. A liquid crystal display apparatus, comprising:

a plurality of pixel electrodes disposed in a plurality of pixels arranged in a matrix form, each pixel having a first circuit, a second circuit and a memory portion, a plurality of first signal lines to apply a voltage to the pixel electrodes, a plurality of second signal lines to apply a voltage to the pixel electrodes, and a plurality of scanning lines intersecting the first signal lines, wherein the first circuit samples a voltage applied to the first signal line corresponding to a voltage applied to the scanning line and applies the sampled voltage to the pixel electrode, the second circuit is connected to the second signal line and the memory portion, selects a voltage applied to the second signal line and applies the selected voltage to the pixel electrode, and the memory portion stores a switched state by a signal supplied from the first circuit and switches alternately between a sampling state and a selected state.

18. The liquid crystal display apparatus as set forth in claim 17, wherein the first circuit includes means for selecting the voltage applied to the pixel electrodes.

19. The liquid crystal display apparatus as set forth in claim 17, wherein a frequency of the first signal line is higher than a frequency of the second signal line.

20. The liquid crystal display apparatus as set forth in claim 17, wherein the second circuit includes a transistor connected to the second signal line and the memory portion, and the memory portion includes a capacitor comprising a ferroelectric insulation film and a capacitor comprising normal dielectric insulation film.

21. The liquid crystal display apparatus as set forth in claim 17, wherein the second signal line includes a strobe line, the second circuit includes a transistor connected to the strobe line and the memory portion, and the memory portion includes of a transistor that has a ferroelectric capacitor.

22. The liquid crystal display apparatus as set forth in claim 17, wherein the first signal line and the second signal line are disposed in parallel or perpendicularly.

23. The liquid crystal display apparatus as set forth in claim 17, further comprising:

a thin film transistor having a ferroelectric film disposed between a gate electrode and a semiconductor film for connecting a source electrode and a drain electrode through a contact region.

24. The liquid crystal display apparatus as set forth in claim 17, wherein the ferroelectric film is one selected from the group consisting of barium titanate, perovskite type substance, layered perovskite, a layered compound, metal oxide and an organic ferroelectric substance selected from the group consisting of a copolymer of vinylidene fluoride and trifluoroethylene and a copolymer of polyvinylidene fluoride and trifluoroethylene.

* * * * *